US007399227B2

(12) United States Patent
Michaelson et al.

(10) Patent No.: US 7,399,227 B2
(45) Date of Patent: Jul. 15, 2008

(54) CENTRAL DETERMINATION GAMING SYSTEM WITH A KENO GAME

(75) Inventors: Richard E. Michaelson, Reno, NV (US); Bryan D. Wolf, Reno, NV (US)

(73) Assignee: IGT, Reno, NV (US)

( * ) Notice: Subject to any disclaimer, the term of this patent is extended or adjusted under 35 U.S.C. 154(b) by 536 days.

(21) Appl. No.: 10/601,482

(22) Filed: Jun. 23, 2003

(65) Prior Publication Data

US 2004/0259629 A1 Dec. 23, 2004

(51) Int. Cl.
*A63F 3/06* (2006.01)

(52) U.S. Cl. ..... 463/18; 463/20

(58) Field of Classification Search ..... 463/16, 463/17, 18, 9–13, 22
See application file for complete search history.

(56) References Cited

U.S. PATENT DOCUMENTS

| | | | |
|---|---|---|---|
| 3,533,629 | A | 10/1970 | Raven et al. |
| 4,033,588 | A | 7/1977 | Watts |
| 4,157,829 | A | 6/1979 | Goldman et al. |
| 4,332,389 | A | 6/1982 | Loyd et al. |
| 4,335,809 | A | 6/1982 | Wain |
| 4,339,798 | A | 7/1982 | Hedges et al. |
| 4,365,810 | A | 12/1982 | Richardson |
| 4,373,726 | A | 2/1983 | Churchill et al. |
| 4,448,419 | A | 5/1984 | Telnaes |
| 4,455,025 | A | 6/1984 | Itkis |
| 4,467,424 | A | 8/1984 | Hedges et al. |
| 4,494,197 | A | 1/1985 | Troy et al. |
| 4,527,798 | A | 7/1985 | Siekierski et al. |
| 4,582,324 | A | 4/1986 | Koza et al. |
| 4,624,462 | A | 11/1986 | Itkis |
| 4,636,951 | A | 1/1987 | Harlick |

(Continued)

FOREIGN PATENT DOCUMENTS

| | | | |
|---|---|---|---|
| GB | 2 374 294 | A | 10/2002 |

(Continued)

OTHER PUBLICATIONS

Big Top Keno Advertisement, written by Aristocrat, published Oct. 2000.

(Continued)

*Primary Examiner*—John M Hotaling, II
*Assistant Examiner*—Dat Nguyen
(74) *Attorney, Agent, or Firm*—Bell, Boyd & Lloyd LLP

(57) ABSTRACT

A central determination gaming system with a keno game. Upon a player initiating a game play at gaming terminal, the gaming terminal enables the player to select a plurality of symbols. The gaming terminal accesses a standard set of predefined symbols for the specific game played. The gaming terminal bidirectionally maps the player's selected symbols with the standard set of predefined symbols. The gaming terminal receives a predetermined game outcome seed from a central controller. The gaming terminal utilizes the selected game outcome seed to generate a plurality of game symbols. The gaming terminal determines if each of the generated game symbols needs to be modified. If so, the gaming terminal modifies these generated game symbols based on the bidirectionally mapping, presents the modified game symbols to the player and provides the player a game outcome that is determined based on the selected game outcome seed.

24 Claims, 8 Drawing Sheets

| | | |
|---|---|---|
| 402 | Player's Selected Numbers | 10, 25, 37, 53, 74 |
| 404 | Standard Set of Predefined Numbers | 1, 2, 3, 4, 5 |
| 406 | Bidirectionally Mapped Numbers | 1/10, 2/25, 3/37, 4/53, 5/74 |
| 408 | Generated Numbers Based on Selected Game Outcome Seed | 2, 4, 7, 13, 15, 23, 29, 37, 41, 45, 48, 49, 62, 65, 77 |
| 410 | Number Marked and Illuminated as Gaming Terminal Selected Numbers | 3, 7, 13, 15, 23, 25, 29, 41, 45, 48, 49, 53, 62, 65, 77 |

U.S. PATENT DOCUMENTS

| | | | |
|---|---|---|---|
| 4,652,998 | A | 3/1987 | Koza et al. |
| 4,669,730 | A | 6/1987 | Small |
| 4,679,143 | A | 7/1987 | Hagiwara |
| 4,689,742 | A | 8/1987 | Troy et al. |
| 4,695,053 | A | 9/1987 | Vazquez et al. |
| 4,756,531 | A | 7/1988 | DiRe et al. |
| 4,775,155 | A | 10/1988 | Lees |
| 4,798,387 | A | 1/1989 | Richardson |
| 4,805,907 | A | 2/1989 | Hagiwara |
| 4,815,741 | A | 3/1989 | Small |
| 4,817,951 | A | 4/1989 | Crouch et al. |
| 4,836,546 | A | 6/1989 | DiRe |
| 4,836,548 | A | 6/1989 | Chittenden |
| 4,842,278 | A | 6/1989 | Markowicz |
| 4,848,771 | A | 7/1989 | Richardson |
| 4,856,787 | A | 8/1989 | Itkis |
| 4,880,237 | A | 11/1989 | Kishishita |
| 4,882,473 | A | 11/1989 | Bergeron et al. |
| 4,982,337 | A | 1/1991 | Burr et al. |
| 5,007,649 | A | 4/1991 | Richardson |
| 5,042,809 | A | 8/1991 | Richardson |
| 5,046,737 | A | 9/1991 | Fienberg |
| 5,092,598 | A | 3/1992 | Kamille |
| 5,100,139 | A | 3/1992 | Di Bella |
| 5,116,049 | A | 5/1992 | Sludikoff et al. |
| 5,119,295 | A | 6/1992 | Kapur |
| 5,158,293 | A | 10/1992 | Mullins |
| 5,223,698 | A | 6/1993 | Kapur |
| 5,242,163 | A | 9/1993 | Fulton |
| 5,265,874 | A | 11/1993 | Dickinson et al. |
| 5,275,400 | A | 1/1994 | Weingardt et al. |
| 5,276,312 | A | 1/1994 | McCarthy |
| 5,282,620 | A | 2/1994 | Keesee |
| 5,297,802 | A | 3/1994 | Pocock et al. |
| 5,324,035 | A | 6/1994 | Morris et al. |
| 5,326,104 | A | 7/1994 | Pease et al. |
| 5,348,299 | A | 9/1994 | Clapper, Jr. |
| 5,351,970 | A | 10/1994 | Fioretti |
| 5,377,975 | A | 1/1995 | Clapper, Jr. |
| 5,393,061 | A | 2/1995 | Manship et al. |
| 5,398,932 | A | 3/1995 | Eberhardt et al. |
| 5,401,024 | A | 3/1995 | Simunek |
| 5,407,199 | A | 4/1995 | Gumina |
| 5,476,259 | A | 12/1995 | Weingardt |
| 5,487,544 | A | 1/1996 | Clapper, Jr. |
| 5,536,008 | A | 7/1996 | Clapper, Jr. |
| 5,542,669 | A | 8/1996 | Charron et al. |
| 5,562,284 | A | 10/1996 | Stevens |
| 5,564,701 | A | 10/1996 | Dettor |
| 5,580,311 | A | 12/1996 | Haste, III |
| 5,586,937 | A | 12/1996 | Menashe |
| 5,595,538 | A | 1/1997 | Haste, III |
| 5,609,337 | A | 3/1997 | Clapper, Jr. |
| 5,628,684 | A | 5/1997 | Bouedec |
| 5,630,754 | A | 5/1997 | Rebane |
| 5,639,089 | A | 6/1997 | Matsumoto et al. |
| 5,645,485 | A | 7/1997 | Clapper, Jr. |
| 5,647,798 | A | 7/1997 | Falciglia |
| 5,657,899 | A | 8/1997 | Stoken |
| 5,674,128 | A | 10/1997 | Holch et al. |
| 5,697,843 | A | 12/1997 | Manship et al. |
| 5,718,631 | A | 2/1998 | Invencion |
| 5,720,483 | A | 2/1998 | Trinh |
| 5,735,432 | A | 4/1998 | Stoken et al. |
| 5,749,784 | A | 5/1998 | Clapper, Jr. |
| 5,755,619 | A | 5/1998 | Matsumoto et al. |
| 5,779,545 | A | 7/1998 | Berg et al. |
| 5,779,547 | A | 7/1998 | SoRelle et al. |
| 5,800,269 | A | 9/1998 | Holch et al. |
| 5,810,664 | A | 9/1998 | Clapper, Jr. |
| 5,830,067 | A | 11/1998 | Graves et al. |
| 5,855,515 | A | 1/1999 | Pease et al. |
| 5,871,398 | A | 2/1999 | Schneier et al. |
| 5,876,283 | A | 3/1999 | Parra et al. |
| 5,882,260 | A | 3/1999 | Marks et al. |
| 5,909,875 | A | 6/1999 | Weingardt |
| 5,915,588 | A | 6/1999 | Stoken et al. |
| 5,928,082 | A | 7/1999 | Clapper, Jr. |
| 5,935,002 | A | 8/1999 | Falciglia |
| 5,941,771 | A | 8/1999 | Haste, III |
| 5,944,606 | A | 8/1999 | Gerow |
| 5,949,042 | A | 9/1999 | Dietz, II et al. |
| 5,954,582 | A | 9/1999 | Zach |
| 5,970,143 | A | 10/1999 | Schneier et al. |
| 5,971,849 | A | 10/1999 | Falciglia |
| 5,980,385 | A | 11/1999 | Clapper, Jr. |
| 5,984,779 | A | 11/1999 | Bridgeman et al. |
| 6,012,984 | A | 1/2000 | Roseman |
| 6,017,032 | A | 1/2000 | Grippo et al. |
| 6,024,640 | A | 2/2000 | Walker et al. |
| 6,033,306 | A | 3/2000 | DeSouza |
| 6,056,289 | A | 5/2000 | Clapper, Jr. |
| 6,062,981 | A | 5/2000 | Luciano, Jr. |
| 6,079,711 | A | 6/2000 | Wei et al. |
| 6,089,976 | A | 7/2000 | Schneider et al. |
| 6,089,982 | A | 7/2000 | Holch et al. |
| 6,093,100 | A | 7/2000 | Singer et al. |
| 6,099,408 | A | 8/2000 | Schneier et al. |
| 6,102,400 | A | 8/2000 | Scott et al. |
| 6,117,009 | A | 9/2000 | Yoseloff |
| 6,120,024 | A | 9/2000 | Lind |
| 6,129,632 | A | 10/2000 | Luciano |
| 6,146,272 | A | 11/2000 | Walker et al. |
| 6,155,925 | A | 12/2000 | Giobbi et al. |
| 6,159,095 | A | 12/2000 | Frohm et al. |
| 6,168,521 | B1 | 1/2001 | Luciano et al. |
| 6,174,233 | B1 | 1/2001 | Sunaga et al. |
| 6,183,361 | B1 | 2/2001 | Cummings et al. |
| 6,203,428 | B1 | 3/2001 | Giobbi et al. |
| 6,210,275 | B1 | 4/2001 | Olsen |
| 6,210,276 | B1 | 4/2001 | Mullins |
| 6,210,279 | B1 | 4/2001 | Dickinson |
| 6,217,448 | B1 | 4/2001 | Olsen |
| 6,220,961 | B1 | 4/2001 | Keane et al. |
| 6,241,606 | B1 | 6/2001 | Riendeau et al. |
| 6,250,685 | B1 | 6/2001 | Walker et al. |
| 6,254,480 | B1 | 7/2001 | Zach |
| 6,273,820 | B1 | 8/2001 | Haste, III |
| 6,280,325 | B1 | 8/2001 | Fisk |
| 6,280,328 | B1 | 8/2001 | Holch et al. |
| 6,283,855 | B1 | 9/2001 | Bingham |
| 6,302,791 | B1 | 10/2001 | Frohm et al. |
| 6,306,038 | B1 | 10/2001 | Graves et al. |
| 6,309,298 | B1 | 10/2001 | Gerow |
| 6,315,289 | B1 | 11/2001 | Sakamoto et al. |
| 6,315,291 | B1 | 11/2001 | Moody |
| 6,325,716 | B1 | 12/2001 | Walker et al. |
| 6,336,862 | B1 | 1/2002 | Byrne |
| 6,358,150 | B1 | 3/2002 | Mir et al. |
| 6,358,151 | B1 | 3/2002 | Enzminger et al. |
| 6,364,313 | B1 | 4/2002 | Moody |
| 6,368,214 | B1 | 4/2002 | Luciano |
| 6,368,218 | B2 | 4/2002 | Angell, Jr. |
| 6,386,977 | B1 | 5/2002 | Hole |
| 6,398,644 | B1 | 6/2002 | Perrie et al. |
| 6,398,645 | B1 | 6/2002 | Yoseloff |
| 6,402,614 | B1 | 6/2002 | Schneier et al. |
| 6,419,583 | B1 | 7/2002 | Crumby et al. |
| 6,425,823 | B1 | 7/2002 | Byrne |
| 6,443,837 | B1 | 9/2002 | Jaffe et al. |
| 6,447,395 | B1 | 9/2002 | Stevens |
| 6,450,885 | B2 | 9/2002 | Schneier et al. |
| 6,454,648 | B1 | 9/2002 | Kelly et al. |
| RE37,885 | E | 10/2002 | Acres et al. |

| | | | |
|---|---|---|---|
| 6,464,582 | B1 | 10/2002 | Baerlocher et al. |
| 6,471,591 | B1 | 10/2002 | Crumby |
| 6,475,086 | B2 | 11/2002 | Zach |
| 6,478,677 | B1 | 11/2002 | Moody |
| 6,508,711 | B1 | 1/2003 | Ono |
| 6,514,144 | B2 | 2/2003 | Riendeau et al. |
| 6,524,184 | B1 | 2/2003 | Lind et al. |
| 6,524,185 | B2 | 2/2003 | Lind |
| 6,527,638 | B1 | 3/2003 | Walker et al. |
| 6,533,660 | B2 | 3/2003 | Seelig et al. |
| 6,533,664 | B1 | 3/2003 | Crumby |
| 6,537,150 | B1 | 3/2003 | Luciano et al. |
| 6,569,017 | B2 | 5/2003 | Enzminger et al. |
| 6,599,187 | B2 | 7/2003 | Gerow |
| 6,645,071 | B2 | 11/2003 | Perrie et al. |
| 6,656,040 | B1 | 12/2003 | Brosnan et al. |
| 6,656,044 | B1 | 12/2003 | Lewis |
| 6,702,699 | B2 | 3/2004 | Touhey et al. |
| 6,729,961 | B1 | 5/2004 | Millerschone |
| 6,739,970 | B2 | 5/2004 | Luciano |
| 6,749,500 | B1 | 6/2004 | Nelson et al. |
| 6,764,397 | B1 | 7/2004 | Robb |
| 6,824,465 | B2 | 11/2004 | Luciano, Jr. |
| 6,855,055 | B2 | 2/2005 | Perrie et al. |
| 2002/0010013 | A1 | 1/2002 | Walker et al. |
| 2002/0039917 | A1 | 4/2002 | Armstrong et al. |
| 2002/0058545 | A1 | 5/2002 | Luciano |
| 2002/0072404 | A1 | 6/2002 | Gerow |
| 2002/0077173 | A1 | 6/2002 | Luciano et al. |
| 2002/0077174 | A1 | 6/2002 | Luciano et al. |
| 2002/0082070 | A1 | 6/2002 | Macke et al. |
| 2002/0082071 | A1 | 6/2002 | Riendeau et al. |
| 2002/0082085 | A1 | 6/2002 | Osterer |
| 2002/0090986 | A1 | 7/2002 | Cote et al. |
| 2002/0094871 | A1 | 7/2002 | Luciano et al. |
| 2002/0098882 | A1 | 7/2002 | Lind et al. |
| 2002/0098883 | A1 | 7/2002 | Packes, Jr. et al. |
| 2002/0111207 | A1 | 8/2002 | Lind et al. |
| 2002/0111214 | A1 | 8/2002 | Lind et al. |
| 2002/0113369 | A1 | 8/2002 | Weingardt |
| 2002/0132661 | A1 | 9/2002 | Lind et al. |
| 2002/0132666 | A1 | 9/2002 | Lind et al. |
| 2002/0169018 | A1 | 11/2002 | Schneier et al. |
| 2003/0100371 | A1 | 5/2003 | Gatto et al. |
| 2003/0100372 | A1 | 5/2003 | Gatto et al. |
| 2003/0125101 | A1 | 7/2003 | Campo |
| 2003/0181231 | A1 | 9/2003 | Vancura et al. |
| 2003/0181234 | A1 | 9/2003 | Falciglia, Sr. |
| 2003/0193136 | A1 | 10/2003 | Walker et al. |
| 2003/0211884 | A1 | 11/2003 | Gauselmann |
| 2004/0014515 | A1 | 1/2004 | Tracy et al. |
| 2004/0106445 | A1 | 6/2004 | Perrie et al. |
| 2005/0014553 | A1 | 1/2005 | Byrne |
| 2005/0227753 | A1 | 10/2005 | Luciano, Jr. |

FOREIGN PATENT DOCUMENTS

| | | |
|---|---|---|
| WO | WO 98/35309 | 8/1998 |
| WO | WO 00/67424 | 11/2000 |
| WO | WO2004/014502 A2 | 2/2004 |

OTHER PUBLICATIONS

Bingo Advertisement, written by WMS Gaming, Inc., published prior to 2003.
Bingo Ball Bingo Advertisement, written by BCSI Corporation, published prior to 2003.
Bingo Brasil Advertisement, written by Unidesa Gaming, published prior to 2003.
Bingo Advertisement, written by Casino Data Systems, published 1998.
Bingo Game Station Advertisement, written by Cole Gaming Technologies, published prior to 2003.
Bingo Party Advertisement, written by Amatic Industries, published 2001.
Bingo Slot Advertisement, written by Unidesa Gaming, published prior to 2003.
Bingo Slots Advertisement, written by Odss on Gaming, published prior to 2003.
Bingo Wizard Advertisement, written by Applied Concepts, published 2002.
Bonus Bingo Advertisement, written by Unidesa Gaming, published prior to 2003.
California Dreams Advertisement by Cadillac Jack, available prior to 2003.
Canadian Bingo Advertisement, written by Unidesa Gaming, published prior to 2003.
Five Card Instant Bingo Advertisement, written by IGT, published 2000.
Diamonopoly Advertisement by International Gamco, Inc., published 2002.
Electronic Pull Tabs Advertisement by 21st Century Gaming, published prior to 2002.
Flamingo Reno-Keno, published prior to 2003.
Gold Touch Multi-Game Advertisement by Cadillac Jack, available prior to 2003.
Instant Bingo Video Slots Advertisement, written by IGT, published 2002.
Instant Winner Advertissement, written by Williams/WMS Gaming, published prior to 2002.
Lucky Times California Lottery Newsletter published 1996.
Keno Advertisement by Odds on Gaming, available prior to 2003.
Keno Advertisement by WMS Gaming, Inc. available prior to 2003.
Keno Advertisement by Cyberdyne Gaming, available prior to 2003.
Krazy Keno, Advertisement by Silicon Gaming, published 2001.
Party Time Bingo Advertisement, written by Astra Games Limited, published prior to 2003.
Play It Again Advertisement, written by International Gamco, Inc., published 2000.
Reel Bingo Advertisement, written by B Soft, published prior to 2003.
Star Spangled Keno, Advertisement by Silicon Gaming, published 2001.
Ultimate Keno Advertisement by Bally Gaming Systems, published 2000.
Dual Screen Keno Machine Picture Advertisement, written by Acres Gaming, Inc., published prior to 2003.
Five Card Instant Bingo Advertisement, written by IGT, published 2000.
Four Card Keno Game Screen Advertisement, written by IGT, published prior to 2001.
Pot O' Gold Advertisement, written by Vision Gaming & Technology, published prior to 2003.
Southern Gold Advertisement, written by Cadillac Jack, published prior to 2003.
Free Game Keno, written by Keno-Info.com (website: www.keno-info.com/free_keno_game.html), website published 2002, printed on Aug. 11, 2002.
Alley Cat Keno Game Description, written by IGT, available prior to Sep. 12, 2002.
Cleopatra Bingo Advertisement, written by IGT, published in 2000 and 2004.
Slingo Games, written by Slingo.com Slingo Games (website: www.slingo.com/games/online/game.php), printed on Apr. 25, 2003.
Cash Keno Paytable, written by IGT, available prior to 2003.
Triple Diamond Keno Paytable, written by IGT, available prior to 2003.

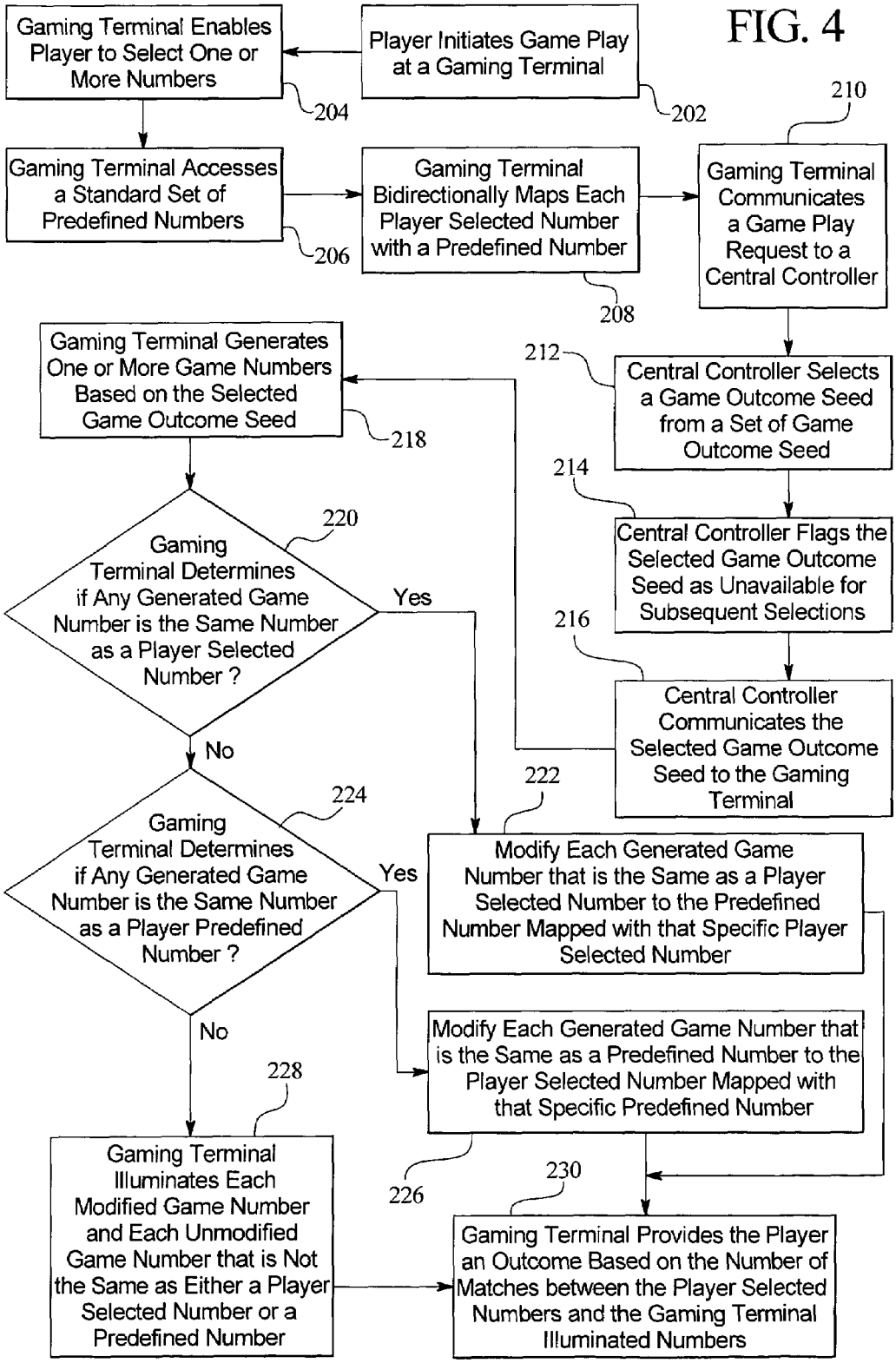
FIG. 4
Player Initiates Game Play at a Gaming Terminal
202
Gaming Terminal Enables Player to Select One or More Numbers
204
Gaming Terminal Accesses a Standard Set of Predefined Numbers
206
Gaming Terminal Bidirectionally Maps Each Player Selected Number with a Predefined Number
208
Gaming Terminal Communicates a Game Play Request to a Central Controller
210
Central Controller Selects a Game Outcome Seed from a Set of Game Outcome Seed
212
Central Controller Flags the Selected Game Outcome Seed as Unavailable for Subsequent Selections
214
Central Controller Communicates the Selected Game Outcome Seed to the Gaming Terminal
216
Gaming Terminal Generates One or More Game Numbers Based on the Selected Game Outcome Seed
218
Gaming Terminal Determines if Any Generated Game Number is the Same Number as a Player Selected Number ?
220
Yes
No
Modify Each Generated Game Number that is the Same as a Player Selected Number to the Predefined Number Mapped with that Specific Player Selected Number
222
Gaming Terminal Determines if Any Generated Game Number is the Same Number as a Player Predefined Number ?
224
Yes
No
Modify Each Generated Game Number that is the Same as a Predefined Number to the Player Selected Number Mapped with that Specific Predefined Number
226
Gaming Terminal Illuminates Each Modified Game Number and Each Unmodified Game Number that is Not the Same as Either a Player Selected Number or a Predefined Number
228
Gaming Terminal Provides the Player an Outcome Based on the Number of Matches between the Player Selected Numbers and the Gaming Terminal Illuminated Numbers
230

FIG. 5

| | | |
|---|---|---|
| 402 | Player's Selected Numbers | 10, 25, 37, 53, 74 |
| 404 | Standard Set of Predefined Numbers | 1, 2, 3, 4, 5 |
| 406 | Bidirectionally Mapped Numbers | 1/10, 2/25, 3/37, 4/53, 5/74 |
| 408 | Generated Numbers Based on Selected Game Outcome Seed | 2, 4, 7, 13, 15, 23, 29, 37, 41, 45, 48, 49, 62, 65, 77 |
| 410 | Number Marked and Illuminated as Gaming Terminal Selected Numbers | 3, 7, 13, 15, 23, 25, 29, 41, 45, 48, 49, 53, 62, 65, 77 |

CENTRAL DETERMINATION GAMING SYSTEM WITH A KENO GAME

CROSS-REFERENCE TO RELATED APPLICATIONS

This application relates to the following commonly owned patent applications: "GAMING DEVICE INCLUDING OUTCOME POOLS FOR PROVIDING GAME OUTCOMES," Ser. No. 10/261,744, "GAMING DEVICE HAVING FREE GAME KENO," Ser. No. 10/243,051, "APPARATUS AND METHOD FOR GENERATING A POOL OF SEEDS FOR A CENTRAL DETERMINATION GAMING SYSTEM," Ser. No. 10/371,722, "CENTRAL DETERMINATION GAMING SYSTEM WITH A CENTRAL CONTROLLER PROVIDING A GAME OUTCOME AND A GAMING TERMINAL DETERMINING A PRESENTATION OF THE PROVIDED GAME OUTCOME," Ser. No. 10/371,723, "CENTRAL DETERMINATION GAMING SYSTEM WHERE THE SAME SEED IS USED TO GENERATE THE OUTCOMES FOR A PRIMARY GAME AND A SECONDARY GAME," Ser. No. 10/371,958, "CENTRAL DETERMINATION GAMING SYSTEM WHICH PROVIDES A PLAYER A CHOICE IN OUTCOMES," Ser. No. 10/442,318, "CENTRAL DETERMINATION GAMING SYSTEM WITH A GAME OUTCOME GENERATED BY A GAMING TERMINAL AND APPROVED BY A CENTRAL CONTROLLER," Ser. No. 10/383,423, "CENTRAL DETERMINATION GAMING SYSTEM WITH A GAMING TERMINAL ASSISTING THE CENTRAL CONTROLLER IN THE GENERATION OF A GAME OUTCOME," Ser. No. 10/431,755, "GAMING DEVICE HAVING GAME WITH SEQUENTIAL DISPLAY OF NUMBERS," Ser. No. 10/639,715, "GAMING DEVICE HAVING MATCHING GAME WITH IMPROVED DISPLAY." Ser. No. 10/953,430, and "GAMING DEVICE HAVING A WAGERING GAME WHEREIN A WAGER AMOUNT IS AUTOMATICALLY DETERMINED BASED ON A QUANTITY OF PLAYER SELECTIONS." Ser. No. 11/011,810.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND OF THE INVENTION

The present invention relates in general to a central determination gaming system, and more particularly to a central determination gaming system with a keno game. The majority of the contemporary wagering gaming devices or gaming terminals randomly generate awards and other outcomes. Such gaming terminals typically include a relatively low probability associated with obtaining the highest award, relatively medium probabilities associated with obtaining medium range awards and relatively higher probabilities associated with obtaining low range awards. These gaming terminals also include probabilities associated with obtaining losses or no award at all. The probabilities of obtaining the awards and the amount of the awards determine the average expected pay out percentage of these wagering gaming terminals. Because the outcomes of these gaming terminals are completely randomly determined, there is no certainty that a player will ever obtain any particular award. That is, no matter how many times a player plays the game, since the gaming terminal generates outcomes randomly or completely based upon a probability calculation, there is no certainty that the game will ever provide the player with a rare outcome, such as a jackpot award, or any other specific value for that matter. On the other hand, due to the random determination, the gaming terminal can provide the rare outcomes, such as jackpot awards, numerous times in a small number of plays. For example, a probability-based $1 gaming terminal may be programmed to payback 95% of all wagers placed with a 1% chance of generating a $10 win outcome, a 5% chance of generating a $5 win outcome, a 10% chance of generating a $2 win outcome, a 40% chance of generating a $1 win outcome and a 44% chance of generating a $0 loss outcome. However, when one hundred game outcomes are generated by the probability-based gaming terminal, the actual payback may be 137% of all wagers placed and the actual generated outcomes may be six $10 win outcomes, one $5 win outcome, eighteen $2 win outcomes, thirty-six $1 win outcomes and thirty-nine $0 loss outcomes.

This uncertainty is faced by players and casinos or other gaming establishments. For example, certain casinos prefer that a relatively high number of players hit low awards while a relatively low number of players hit high awards. When players hit high awards periodically, casinos attract more players, because of the positive publicity large wins generate. By using desired payback percentages or probabilities, the casinos can also expect to make a certain level of profit. The random determinations can, however, unexpectedly cause casinos to suffer a loss or, on the other hand, to reap great profit in the short run and lose business in the long run due to a reputation for only paying out low awards.

Regulatory bodies in certain jurisdictions do not permit the use of probability-based gaming terminals, in part for these reasons. These regulatory bodies permit the use of wagering gaming terminals which are guaranteed to provide certain or definite awards, so that, for example, a certain number of wins is guaranteed and the overall amount paid back to players is guaranteed. That is, the payback percentage is fixed and not an average expected amount. One type of gaming terminal which complies with this requirement is an instant-type lottery gaming terminal. An instant-type lottery gaming terminal includes a finite pool or set of electronic tickets with each electronic ticket assigned to or having a predetermined outcome. Alternatively, each electronic ticket could be assigned to a random number or game play seed. Each seed is deterministic of a predetermined outcome. That is, the gaming terminal utilizes the random number or game play seed in a random number generating algorithm to generate random numbers that the gaming terminal then uses to determine and provide the predetermined outcome. In an instant-type lottery gaming terminal, as the predetermined outcome for each electronic ticket is revealed to a player on the gaming terminal, the ticket is removed (i.e., flagged as used) from the finite pool or set of electronic tickets. Once removed from the pool or set, a ticket cannot be used again to determine another game outcome. This type of gaming terminal provides players with all of the available outcomes over the course of the play cycle and guarantees the actual wins and losses.

Since an instant-type lottery gaming machine has a finite pool of predetermined win/loss outcomes, it is possible to configure the pool to specific conditions or criteria requested by the casino or gaming establishment. An example of these conditions or criteria are the number of tickets included in the pool and the exact payback percentage or payback sum for the pool as a whole. The payback percentage or sum represents the guaranteed payout for the entire pool of predetermined outcomes. Other examples of conditions or criteria are what prizes will be awarded and the frequency of winning outcome tickets amongst the total number of tickets for the pool. For example, if a predetermined pool includes twenty $1 tickets and the pool has a payback sum of $10, then the pool might consist of one $5 win outcome, one $2 win outcome, three $1 win outcomes and fifteen $0 loss outcomes and may be represented as the following outcomes: 5, 2, 1, 1, 1, 0, 0, 0, 0, 0, 0, 0, 0, 0, 0, 0, 0, 0, 0, 0. It should be appreciated that the above described pool of twenty tickets is for illustration purposes only and a pool could include any suitable desired number of tickets including a large number such as one million or more.

Central determination gaming systems are also generally known. A central determination gaming system provides a plurality of individual gaming terminals, located in a gaming establishment, such as a casino, coupled by one or more communication links, to a central processor or controller. When a player plays a game on one of the gaming terminals, a game outcome is randomly generated based on probability data by the central controller. The generated game outcome and how the game outcome is to be presented or displayed to the player are communicated from the central controller to the individual gaming terminal and then provided to the player. It should be appreciated that one central processor may continuously run hundreds or thousands of individual gaming terminals at once. Additionally, each individual gaming terminal may include a plurality of different types of games played at a plurality of different denominations.

In order to comply with the above mentioned regulatory rules that do not permit the use of probability-based gaming terminals, central determination gaming systems have been implemented wherein the central system maintains one or more predetermined pools or sets of game outcomes. Each game outcome in each set or pool includes a game outcome component (i.e., a win, a lose, a secondary game trigger or other suitable outcome) with an associated value or payout amount, if any, and a game presentation component (i.e., how the game outcome is displayed or presented to the player). In these systems, when a player makes a wager on one of the gaming devices, the central system independently selects a game outcome from a set or pool of game outcomes and flags or marks the selected game outcome as used. Once a game outcome is flagged as used, it is prevented from further selection from the set or pool and cannot be selected by the central controller upon another wager. The selected game outcome is communicated to the individual gaming terminal. The individual gaming terminal displays or presents the game presentation component and provides the player the game outcome component with the associated value, if any, for the selected game outcome. Additionally, certain central determination gaming systems have also been implemented wherein the central system maintains one or more predetermined pools or sets of random number or game outcome seeds.

There are a number of advantages to providing for centralized production of game outcomes at individual gaming terminals. Central production or control can assist a casino or other entity in maintaining appropriate records, controlling gaming, reducing and preventing cheating or electronic or other errors, reducing or eliminating win-loss volatility and the like.

Gaming devices having a primary or base game and a secondary or a bonus game are also well known. A secondary or bonus game may be any type of suitable game, either similar to or completely different from the primary game, which is entered upon the occurrence of a triggering event or a selected outcome in the primary game. The secondary or bonus game enables the player to obtain a prize or payout in addition to the prize or payout, if any, obtained from the primary game. A secondary or bonus game may produce a significantly higher level of player excitement than the primary game because it provides a greater expectation of winning than the primary game and is accompanied with more attractive or unusual features than the primary game.

Keno games are also generally known. Keno is similar to a lottery game. The goal, like a lottery, is to choose a winning number or winning numbers from a plurality of numbers. In most standard versions of paper or video based Keno, the player receives a card with eighty squares numbered one to eighty, arranged in rows of ten. The player can bet on any number or numbers, up to a designated amount, such as fifteen numbers, which the player does by marking selected numbers on a Keno card or selecting the numbers on a keno display. A clerk or the processor of the video display records the player's bet(s), wherein the player pays for each number played or wagered.

In the casino version, the Keno numbers also appear on eighty ping pong type balls, which can be tossed about in a clear plastic sphere or spun around in a wire bird cage. In an alternative video version, a computer using a random number generator generates the Keno numbers. When a number is chosen, the number is shown electronically on Keno boards throughout the casino or on the video display. An award is provided to the player based on the amount of matches between the player selected number(s) and the game generated number(s).

Known variations of Keno, for example 'multi-race' keno, 'walk away' keno and 'way' ticket keno, do not affect the mathematics, payout or expected return of the game. It does not mathematically matter how many numbers the player chooses or if the player combines wagers. The player can choose less numbers if the player likes to win a smaller amount but a little more often. The player can choose more numbers if the player does not care about the frequency of the wins but wants bigger payouts.

As the game outcome in a keno game is randomly determined and the game outcome in a central determination gaming system is predetermined, no known keno game has been implemented with a central determination gaming system. That is, in a keno game since the game or gaming terminal randomly generates at least one and preferably a plurality of numbers, the game outcome provided to the player is therefore also randomly determined (i.e., based on the number or amount of player picked numbers that match the game or gaming terminal randomly generated numbers). On the other hand, the game outcomes of a game in a central determination gaming system are not randomly determined, but are predetermined and stored in a set or pool until being provided to the player. Therefore, a need exists for a central determination keno gaming system that enables the player to play any available numbers, enables the game or gaming terminal to randomly generate any of the available numbers and still provides a predetermined game outcome to the player.

SUMMARY OF THE INVENTION

The present invention relates to a central determination gaming system which is operable to implement and determine outcomes for a keno game and particularly a video based keno gaming machine. In a keno game, as described above, the game randomly generates numbers and because the game outcome is based on the number of matches between the player's picked numbers and these randomly generated numbers, the game outcome is also randomly determined. In other words, no known keno game enables the game to randomly generate game numbers while still providing the player a predetermined game outcome.

In one embodiment, the central determination keno game of the present invention provides a keno game that enables the game to randomly generate at least one and preferably a plurality of numbers while providing the player a predetermined game outcome. That is, by multidirectional mapping, such as bidirectional mapping as described in more detail below, the present invention modifies the game's randomly generated numbers in order to ensure that the game outcome which is based on the number of matches between the player's picked numbers and the modified game generated numbers corresponds to the predetermined game outcome. This causes the player of numerous games to continue to feel completely like playing currently known keno games in which the results are completely randomly determined. In other words, the method of the present invention has or provides the same "feel" for or to the player as current keno games.

In one embodiment of the present invention, upon a player initiating a game play, preferably by making a wager, at one of a plurality of gaming terminals in communication with a central controller, the gaming terminal enables the player to select one or more numbers or game choices to play from a plurality of different player selectable numbers. In one embodiment, the gaming terminal enables the player to select a predetermined number of player selectable numbers. In another embodiment, the gaming terminal enables the player to select up to a predetermined number of player selectable numbers, such as enabling the player to pick up to twenty numbers from the numbers one to eighty. It should be appreciated that each different number of player selectable numbers the player picks is considered a different keno game played with a different paytable or prize structure. That is, the player picking five player selectable numbers is one keno game and the player picking eight player selectable numbers is considered a different keno game with possibly a different paytable or prize structure.

After the player has selected one or more player selectable numbers, the gaming terminal accesses a standard set of predefined numbers for the specific game played. The numbers included in the standard set of predefined numbers are from the same plurality of player selectable numbers that the player is enabled to select one or more numbers from. The standard set of predefined numbers includes at least one number for each selected number the player elected to play. That is, if the player selected five numbers, the standard set of predefined numbers would include at least five numbers from the plurality of player selectable numbers. If the player selected ten numbers, the standard set of predefined numbers would include at least ten numbers from the plurality of player selectable numbers. It should be appreciated that the standard set of predefined numbers for each specific type of keno game played on each of the plurality of gaming terminals in communication with the central controller are the same. For example, each gaming terminal in the system accesses the same set of five predefined numbers for each five number keno game (i.e., the player picks five numbers) played.

In the preferred embodiment, the gaming terminal then bidirectionally maps the player's selected numbers with the standard set of predefined numbers. That is, each one of the player's selected numbers is mapped onto a different one of the predefined numbers and the predefined number is reciprocally mapped onto the player selected number. As described above, the standard set of predefined numbers includes at least the same amount of numbers as the amount of player selected numbers, therefore each player selected number will be bidirectionally mapped with a different predefined number. It should be appreciated that if the player selected number is the same as the predefined number (i.e., the player selected number 17 and number 17 is also included in the standard set of predefined numbers) then the player selected number is still bidirectionally mapped with the predefined number. That is, the same number is preferably mapped onto itself. It should be appreciated that in alternative embodiments, the gaming terminal could multidirectionally map the player's selected numbers with the standard set of predefined numbers.

After the gaming terminal bidirectionally maps each player selected number with a predefined number, the gaming terminal communicates a game outcome seed request to a central controller. The game play outcome request includes information or data regarding the amount of numbers the player selected, such as information that the player selected five numbers.

Upon receiving the game outcome seed request, the central controller selects a game outcome seed from a set or pool of game outcome seeds. The central controller selects the game outcome seed from the set or pool that corresponds to the amount of numbers the player selected or the specific keno game played. For instance, if the player selected four numbers, the central controller selects the game outcome seed from a different set or pool than had the player selected six numbers.

Each game outcome seed is a unique random number seed which is deterministic of at least one and preferably a plurality of numbers and ultimately, a game outcome, such as a win outcome, a lose outcome or a secondary or bonus game triggering outcome. It should be appreciated that with reference to an appropriate paytable or prize structure, each game outcome seed is deterministic of and corresponds to a number of matches between the numbers generated based on the game outcome seed and the player's selected numbers. For example, one game outcome seed may be deterministic of twenty numbers which when modified using the bidirectional map and compared to the player's selected numbers, as discussed in more detail below, corresponds to a win $1 game outcome while another game outcome seed for the same game played may be deterministic of twenty different numbers which when modified using the same bidirectional map and compared to the player's same selected numbers corresponds to a win $5 game outcome in the keno game of the present invention.

The central controller marks or flags the selected game outcome seed in the pool as used or unavailable. Once a game outcome seed is marked or flagged it is prevented from a subsequent selection from the pool upon another game play. The central controller communicates the selected game outcome seed to the requesting gaming terminal.

After acknowledging receipt of the selected game outcome seed, the gaming terminal utilizes the selected game outcome seed to generate at least one and preferably a plurality of game numbers. In one embodiment, the gaming terminal utilizes the selected game outcome seed in a random number generating algorithm to generate at least one and preferably a plurality of random numbers. The gaming terminal then utilizes the generated random numbers to determine or generate the game numbers.

In one embodiment, the gaming terminal determines if each of the generated game numbers needs to be modified prior to be being presented or illuminated to the player in order to ensure that the game outcome that is based on the number of matches between the player's selected numbers and the gaming terminal generated presented numbers is the same as the predetermined game outcome which is based on the game outcome seed. That is, as the game outcome seed is deterministic of a game outcome and the game outcome of a keno game is based on the number of matches between the player's selected numbers and the gaming terminal presented generated numbers, the gaming terminal may need to modify (by using the bidirectional mapping) at least one of the generated game numbers so that the number of matches the player obtains in the keno game corresponds to the number of matches of the predetermined game outcome. For example, if the game outcome seed for a keno game that enables the player to select ten numbers is deterministic of a win $3 outcome (which requires the player to match four of the ten selected numbers with the gaming terminal presented generated numbers) and if the player's selected numbers and the unmodified gaming terminal generated game numbers results in five matches (which according to the appropriate paytable results in a win $6 outcome), the unmodified gaming terminal generated game numbers would need to be modified to ensure that the player obtains four matches.

The above described modification occurs by the gaming terminal determining if each of the generated numbers is the same number as either a player selected number or a predefined numbers. That is, the gaming terminal determines if each of the generated numbers based on the game outcome seed has previously been bidirectionally mapped onto another number.

For each unmodified generated number that is the same as a predefined number, the gaming terminal marks or illuminates the player selected number that is bidirectionally mapped with the predefined number. For example, if based on the game outcome seed, the gaming terminal generated the number twelve and the number twelve was also a predefined number (that was previously bidirectionally mapped with the player selected number forty-five), then the gaming terminal would mark or illuminate the player selected number forty-five.

For each unmodified generated game number that is the same as a player selected number, the gaming terminal marks or illuminates the predefined number that is bidirectionally mapped with that player selected number. For example, if based on the game outcome seed, the gaming terminal generated number twenty-one and the number twenty-one was also selected by the player (and previously bidirectionally mapped with the predefined number thirty-two), then the gaming terminal would mark or illuminate the predefined number thirty-two.

For each generated number that is not the same number as either a player selected number or a predefined number, the gaming terminal marks or illuminates the unmodified generated number.

After displaying or presenting a plurality of numbers, the gaming terminal compares the gaming terminal marked or illuminated numbers with the player's selected numbers. The gaming terminal provides the player a game outcome based on the amount of matches between the marked or illuminated numbers and the player's selected numbers. It should be appreciated that this game outcome is the same game outcome that the selected game outcome seed is deterministic of. That is, the present invention provides a keno game that enables a player to freely select a plurality of numbers and enables a gaming terminal to randomly generate a plurality of game numbers based on a game outcome seed while still providing a predetermined game outcome.

It should be appreciated that any player selected number that randomly matches a gaming terminal generated game number would alter the predetermined game outcome. Therefore, by controlling or modifying (by bidirectionally mapping) which gaming terminal generated game numbers are marked or illuminated, the present invention ensures that the game outcome (which is indicated as the number of matches between the player's selected numbers and the gaming terminal generated game numbers) remains predetermined. In other words, the present invention is operable to modify (by bidirectionally mapping the predefined numbers with the player's selected numbers) the gaming terminal generated game numbers that are presented or illuminated to the player in order to provide the player with the predetermined game outcome which is based on the game outcome seed.

The present invention provides a number of advantages over existing central determination gaming systems. One advantage is the present invention provides a keno game that enables players to select and play any numbers and enables the game to randomly generate game numbers while still providing predetermined game outcomes. That is, the present invention provides the advantage of a network of contemporary gaming terminals that enable increased levels of player interaction and participation while also complying with certain jurisdictional regulations that require gaming terminals which are guaranteed to provide certain or definite awards. This increases the player's level of excitement and enjoyment because the network of gaming terminals in the central determination gaming system retains the look and feel of contemporary probability based gaming terminals.

In an alternative embodiment of the present invention, the gaming terminal randomly bidirectionally maps the player's selected numbers with one standard set of predefined numbers and randomly bidirectionally maps the remaining non-selected numbers with another standard set of predefined numbers. In this embodiment, upon a player initiating a game at one of the gaming terminals, the initiated gaming terminal enables the player to select one or more numbers as described above. The gaming terminal accesses one standard set of predefined numbers and bidirectionally maps each of the player's selected numbers with a predefined number from this standard set of predefined numbers. The gaming terminal than accesses a second standard set of predefined numbers and bidirectionally maps each of the remaining non-selected numbers with a predefined number from this second standard set of predefined numbers. This embodiment proceeds as described above, with the gaming terminal communicating a game outcome seed request to the central controller (wherein the request includes information or data regarding the number of numbers picked or selected by the player), and the central controller selecting a game outcome seed from a set or pool of game outcome seeds for the specific game played (i.e., the number of numbers selected by the player), flagging the selected game outcome seed as used and communicating the selected game outcome seed to the requesting gaming terminal.

The gaming terminal utilizes the game outcome seed to generate one or more game numbers. In this embodiment, for each generated number, the gaming terminal marks or illuminates the corresponding number that each generated number is bidirectionally mapped with. It should be appreciated that in this embodiment, since each available number (both player selected numbers and non-selected numbers) is bidirectionally mapped with another number, the gaming terminal will determine the number that each generated number is bidirectionally mapped with and mark or illuminate these determined bidirectionally mapped numbers. This embodiment proceeds as described above by providing the player a game outcome based on the amount of matches between the marked or illuminated numbers and the player's selected numbers. It should be appreciated that, as described above, the provided game outcome will be the same game outcome that the selected game outcome seed is deterministic of.

This embodiment provides the advantage of reducing the amount of different game outcome seeds the central controller must maintain in each set or pool of game outcome seeds. That is, since each game outcome seed does not need to be deterministic of different lose numbers (numbers marked by the gaming terminal but not selected by the player), the pool or set of game outcome seeds need only contain one game outcome seed that is deterministic of each available game outcome (i.e., the number of matches obtained). In this embodiment, since the non-selected numbers are randomly bidirectionally mapped with numbers from a second standard set of predefined numbers, a plurality of game outcome seeds can each be deterministic of the same lose numbers because the actual lose number marked or illuminated by the gaming terminal will not be the generated lose number, but each of the lose numbers respective corresponding bidirectionally mapped number. Moreover, as the non-selected numbers are bidirectionally mapped with numbers from the second standard set of predefined numbers each time a player initiates the gaming terminal, a plurality of the same game outcomes, such as the player obtaining five matches, will be displayed differently to the player even though the same game outcome seed is used to determine the same game outcome.

In another embodiment of the present invention, upon a player initiating a game play at one of the gaming terminals in communication with the central controller, the gaming terminal enables the player to select one or more numbers to play from a plurality of different player selectable numbers as described above. In this embodiment, after the player selects one or more player selectable numbers, the gaming terminal communicates a game outcome seed request (which includes information or data regarding the number of player selectable numbers the player picked) to the central controller. It should be appreciated that in this embodiment, the gaming terminal does not bidirectionally map the player's selected numbers with any predefined numbers. The central controller then selects a game outcome seed from a set of game outcome seeds for the specific keno game played, flags the selected game outcome seed and communicates the selected game outcome seed to the requesting gaming terminal.

In this embodiment, the gaming terminal determines the game outcome that the received game outcome seed is deterministic of and provides the player the determined game outcome. The gaming terminal presents the determined game outcome to the player by determining the number of matches between the player's selected numbers and the gaming terminal marked or illuminated numbers for the determined game outcome and then marking or illuminating the appropriate number of player selected numbers to correspond to the determined number matches. For example, if the game outcome seed is deterministic of a win $3 game outcome and according to an appropriate paytable for the specific game played, a win $3 game outcome corresponds to two of the player's ten selected numbers matching the twenty gaming terminal marked numbers, the gaming terminal will mark or illuminate two of the player's selected numbers and mark or illuminate eighteen non-selected numbers. In this embodiment, the gaming terminal will randomly mark two of the player's ten selected numbers and randomly mark eighteen of the remaining non-selected numbers.

Additional features and advantages of the present invention are described in, and will be apparent from, the following Detailed Description of the Invention and the figures.

BRIEF DESCRIPTION OF THE FIGURES

FIG. 4 is a schematic block diagram illustrating one embodiment of the present invention wherein gaming terminal may modify, if needed, one or more of the generated game numbers prior to being presented to the player in order to provide the player the predetermined game outcome that is based on the central controller selected game outcome seed.

FIG. 5 is a table illustrating the relationship between the player's selected numbers, the standard set of defined numbers and the gaming terminal numbers that are generated based on the selected game outcome seed.

DETAILED DESCRIPTION OF THE INVENTION

Figure 1:
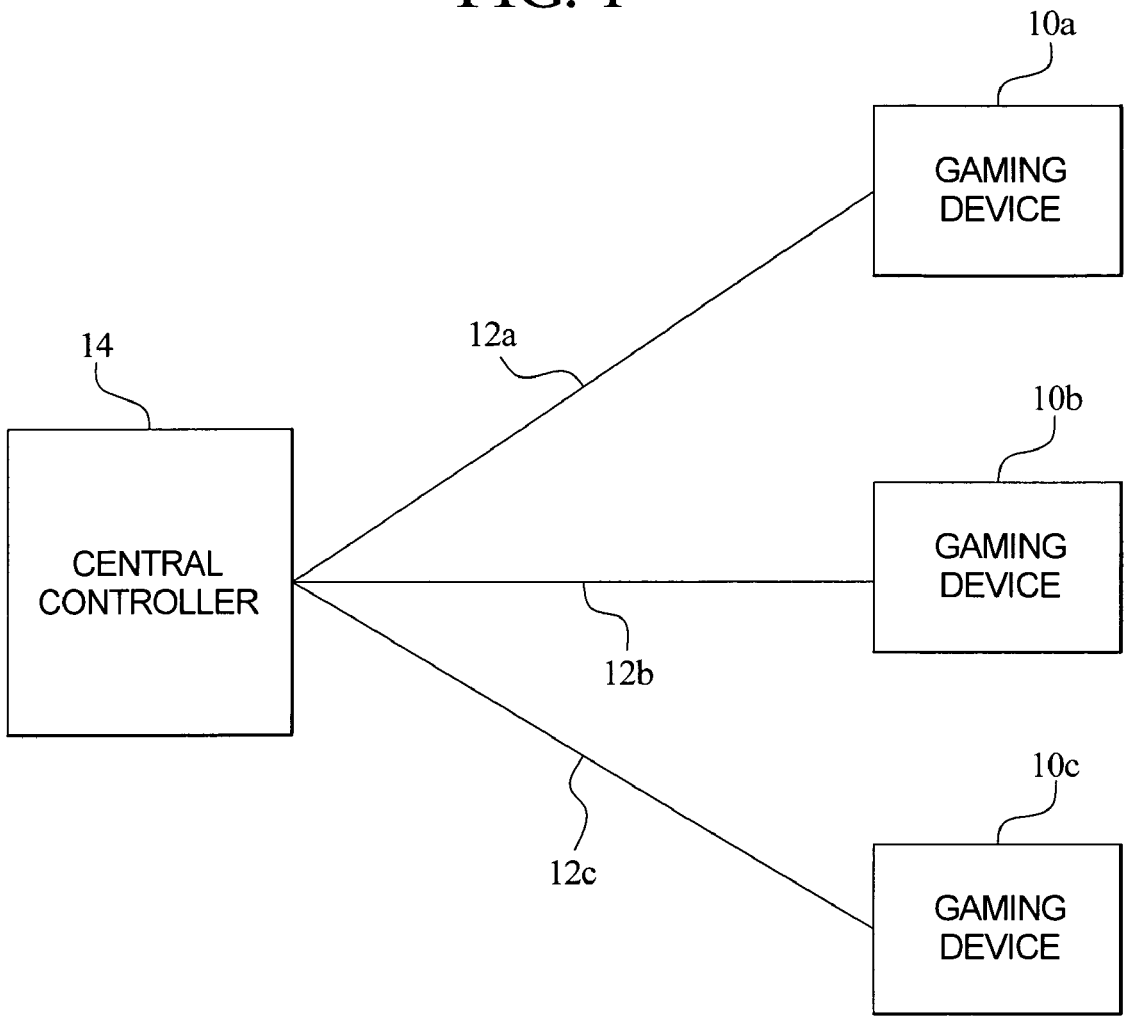
FIG. 1 is a schematic block diagram illustrating a plurality of gaming terminals in communication with a central controller.

Referring now to the drawings, as illustrated in FIG. 1, one embodiment of the present invention includes a plurality of gaming devices or gaming terminals 10*a*, 10*b* and 10*c* located in a gaming establishment, such as a casino, coupled by one or more communication links 12*a*, 12*b* and 12*c* to a central computing system or central controller 14. The communication links 12 can be any of a plurality of devices known to those of skill in the art for receiving data transmissions to and from the gaming terminal. The central controller maintains supervision over the entire network of gaming terminals.

In one embodiment, the central controller maintains at least one predetermined set or pool of predetermined game outcome seeds for each type of game provided on the gaming terminals. That is, each different number of player selectable numbers the player picks to play is considered a different keno game (with possibly a different paytable or prize structure) and the central controller maintains at least one set of predetermined game outcome seeds for each different keno game played in the present invention. For example, the central controller maintains at least one set of predetermined game outcome seeds for a keno game in which the player selects four numbers and another set of predetermined game outcome seeds for a keno game in which the player selects eight numbers. In an alternative embodiment, the central controller maintains a plurality of predetermined sets or pools of predetermined game outcome seeds for each keno game provided on the gaming terminals. In another embodiment, the central controller maintains a predetermined set or pool of predetermined game outcome seeds for each denomination for each keno game provided on the gaming terminals. In another embodiment, the central controller maintains at least one predetermined set or pool of predetermined game outcomes. In this embodiment, each predetermined game outcome includes an indication of a plurality of game numbers to be utilized as game numbers as described below. Other methods for storing the pool or set of predetermined game outcome seeds or game outcomes may be employed in accordance with the present invention.

In one embodiment, each game outcome seed is deterministic of a plurality of game numbers and also a predetermined game outcome. That is, each game outcome seed is a unique random number seed which is deterministic of at least one and preferably a plurality of number and ultimately a game outcome, such as a win outcome, a lose outcome or a secondary or bonus game triggering outcome, with an associated value or pay amount, if any. For example, one game outcome seed may be deterministic of twenty numbers which when modified using the bidirectional map and compared to the player's selected numbers, as discussed in more detail below, corresponds to a win $1 game outcome while another game outcome seed for the same game played may be deterministic of twenty different numbers which when modified using the same bidirectional map and compared to the player's same selected numbers corresponds to a win $5 game outcome in the keno game of the present invention.

With reference to an appropriate paytable for the specific keno game played, each game outcome seed is deterministic of the number of matches between the player's picked numbers and the gaming terminal marked or illuminated numbers. That is, since the game outcome is predetermined and the number of matches between the player's selected numbers and the gaming terminal generated numbers directly corresponds to the game outcome, the number of matches could be determined from the game outcome seed as well. For example, if a game outcome seed is deterministic of a win $3 outcome and according to the paytable for the game played, a win $3 outcome corresponds to four matched numbers, then the game outcome seed is deterministic of four matches between the player's picked numbers and the gaming terminal marked or illuminated game numbers. Thus, for any given seed, it is possible to determine the game outcome that will result which is represented as the number of matches between the player's picked numbers and the gaming terminal marked or illuminated game numbers.

A plurality of seeds in each set or pool of predetermined game outcome seeds are each deterministic of the same game outcome. For example, if a paytable of a game indicates six different possible game outcomes (i.e., a win $20 game outcome, a win $10 game outcome, a win $5 game outcome, a win $2 game outcome, a win $1 game outcome and a lose game outcome) and the set or pool of game outcome seeds includes one million game outcome seeds, then a plurality of the game outcome seeds will each be deterministic of the same game outcome.

In one embodiment, all of the gaming terminals which are coupled to the central processor are configured to play the same type of keno game. In an alternative embodiment, a plurality of the gaming terminals are configured so that different gaming terminals may be used to play different types of keno games. In another embodiment, some gaming terminals of the present invention may also be used for playing a slot machine style game, others may be also be used for playing a poker style game, others may also be used for playing a blackjack style game, and the like. In another embodiment, a plurality of gaming terminals may each be configured for also playing a plurality of different games.

Figure 2A:
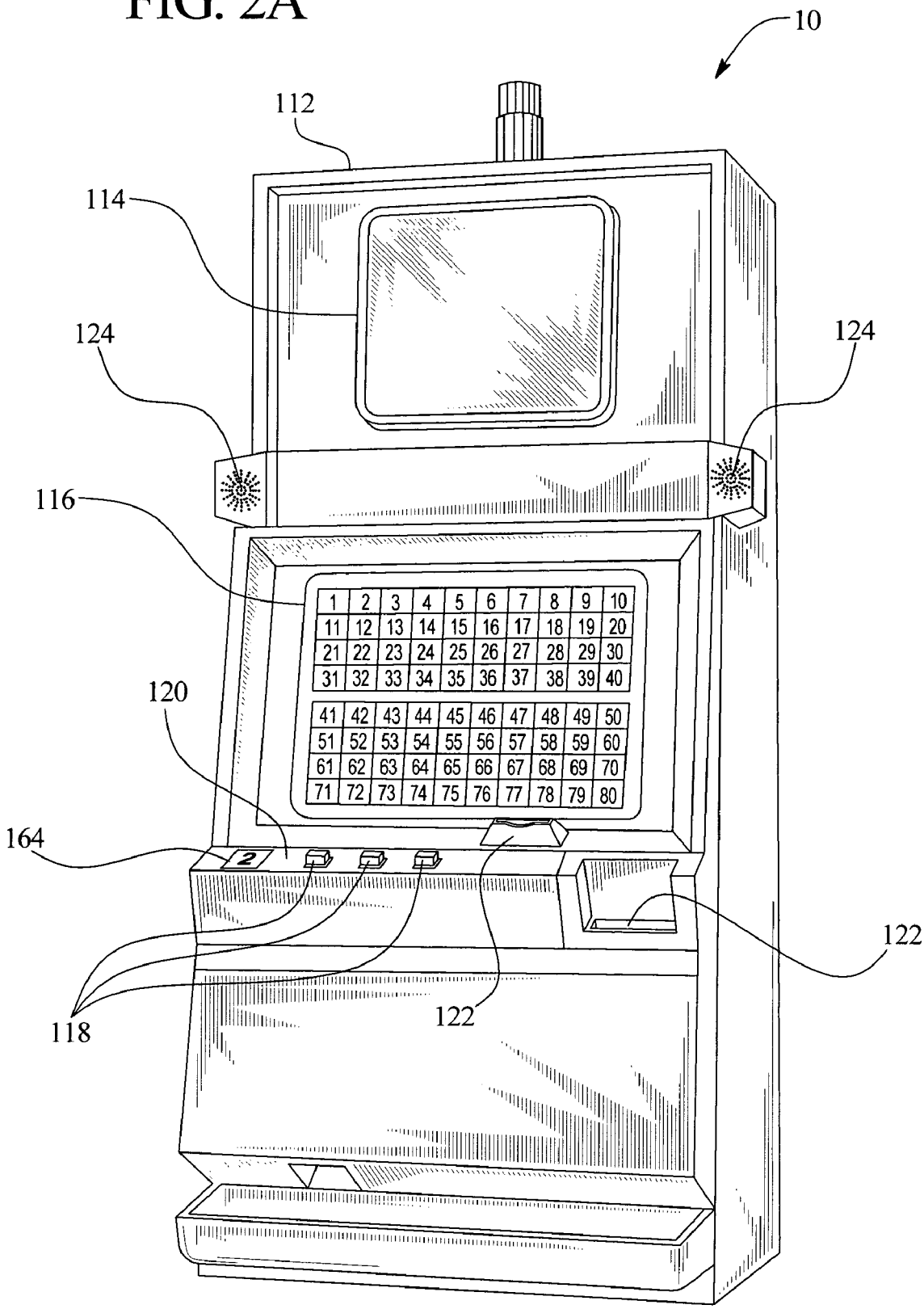
FIGS. 2A to 2C are perspective views of one embodiment of the gaming terminal of the present invention illustrating the player selecting numbers and the gaming terminal generating numbers based on the selected game outcome seed.
Figure 2B:
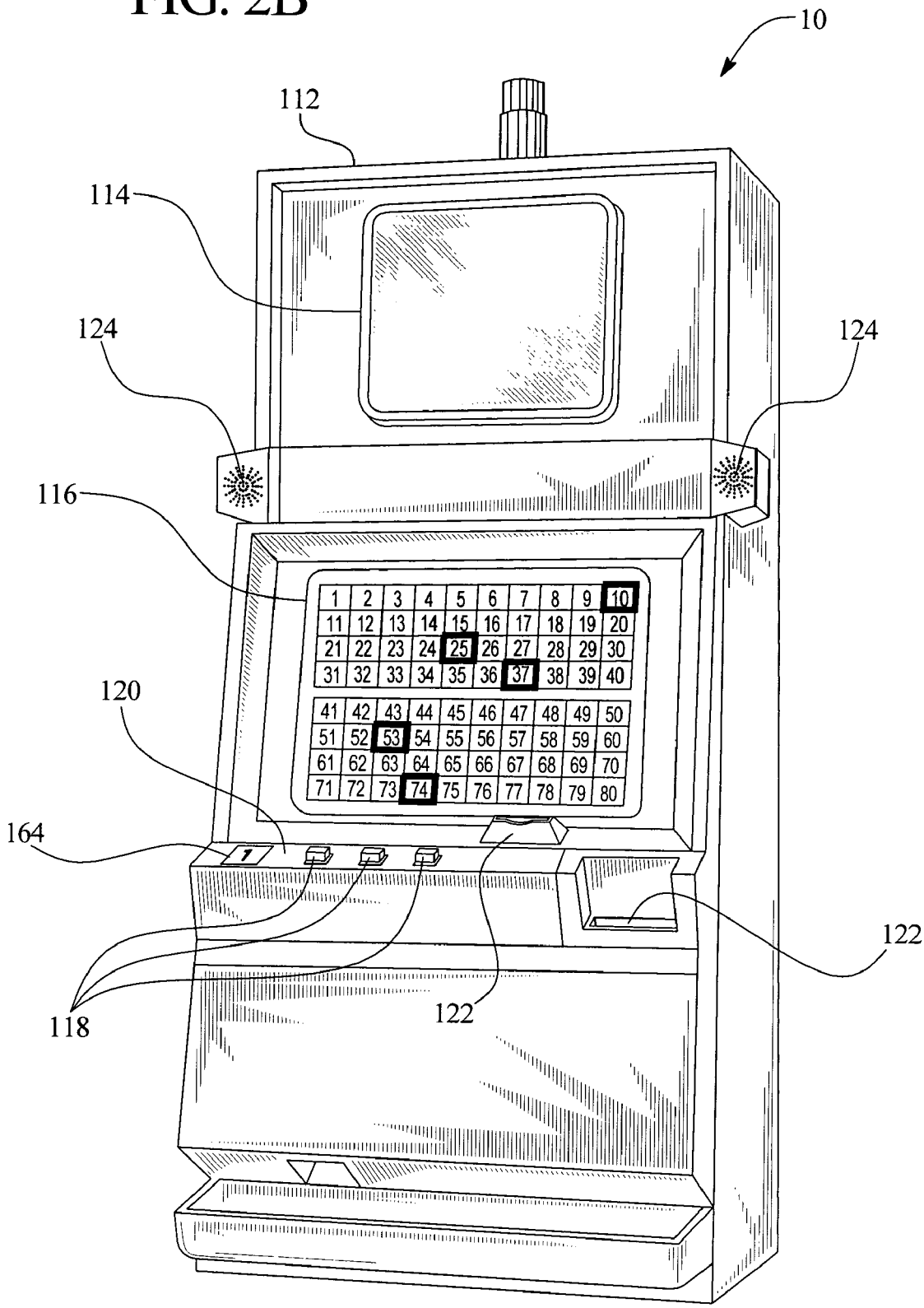
Figure 2C:
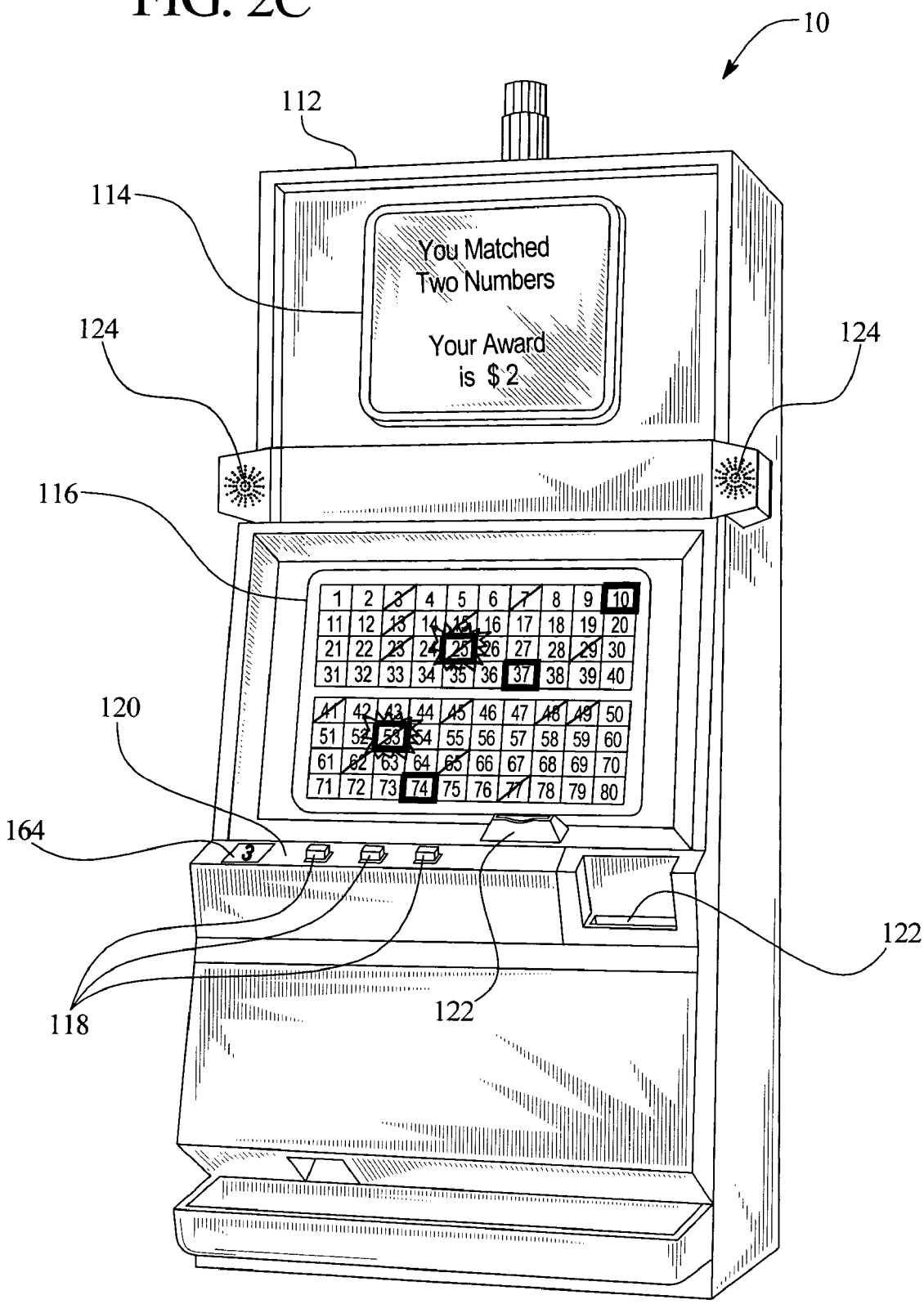

Referring now to FIGS. 2A to 2C, each of the embodiments described herein is provided in one preferred embodiment in a gaming terminal 10. Alternatively, the embodiments are provided on various monitors throughout a casino or gaming establishment. Gaming terminal 10 is in one embodiment a video gaming device and includes a cabinet 112 having at least one video monitor. The illustrated embodiment includes two video monitors 114 and 116. Cabinet 112 is illustrated as being of a type where the player stands or sits. The cabinet is alternatively a bar top cabinet, wherein the player sits to play the Keno game of the present invention.

The cabinet 112 also provides controls for a player to operate gaming terminal 10. In the illustrated embodiment, various electromechanical input devices 118 are provided on a tilted portion 120 of the cabinet 112, below video monitors 114 and 116. Electromechanical input devices 118 each send a discrete signal to a microprocessor located within cabinet 112. These input devices enable the player to perform the various Keno functions, including but not limited to, selecting at least one of the Keno numbers or game choices, playing multiple games at once, wagering a number of credits per game and cashing out. The input devices 118 may also enable the player to play multiple Keno games in a row.

Similar to the electromechanical input devices 118, cabinet 112 of gaming terminal 10 can provide electromechanical displays that show, for example, the player's credits maintained within gaming terminal 10, the number of Keno numbers played, the bet per game, etc. In one preferred embodiment, however, these functions as well as others are provided on one or more video monitor or display devices 114 and 116. In one embodiment, display device 114 may show the pays for a number of hits or matches between the numbers or game choices that the player selects and the numbers or game choices that gaming terminal 10 marks or illuminates. Displays 114 and 116 can also inform the player of the rules concerning the operation of the Keno game of the present invention.

Video monitors 114 and 116 display, among other items: (i) the Keno numbers or game choices generated by the gaming terminal 10 based on the game outcome seed; (ii) the modified Keno numbers or game choices; (iii) the numbers played by the player; (iv) the wager per game; (v) the player's total wager and (vi) the player's Keno award, if any. In one embodiment, credit display 164 displays the player's accumulated credits. In one embodiment, when the player selects a number or game choice, gaming terminal 10 highlights it as a certain color, for example, yellow. When the gaming device generates a number or game choice or uses the bidirectional map to modify a number or game choice, gaming terminal 10 highlights it as a different color, for example, blue. When a match occurs, the number is highlighted by a third color, for example, green, a combination of blue and yellow.

Cabinet 112 of gaming terminal 10 also includes one or more monetary input devices 122. The monetary input device 122 can accept coins, cash, a smart card, a credit card, a debit card, a casino card or other type of gaming device card. Keno gaming terminal 10 can also include a ticket reader and a ticket printer (not illustrated) that enables the player to input and receive a redeemable ticket in lieu of cash. The ticket reader/validator and printer operate with a processor housed inside gaming terminal 10.

Figure 3:
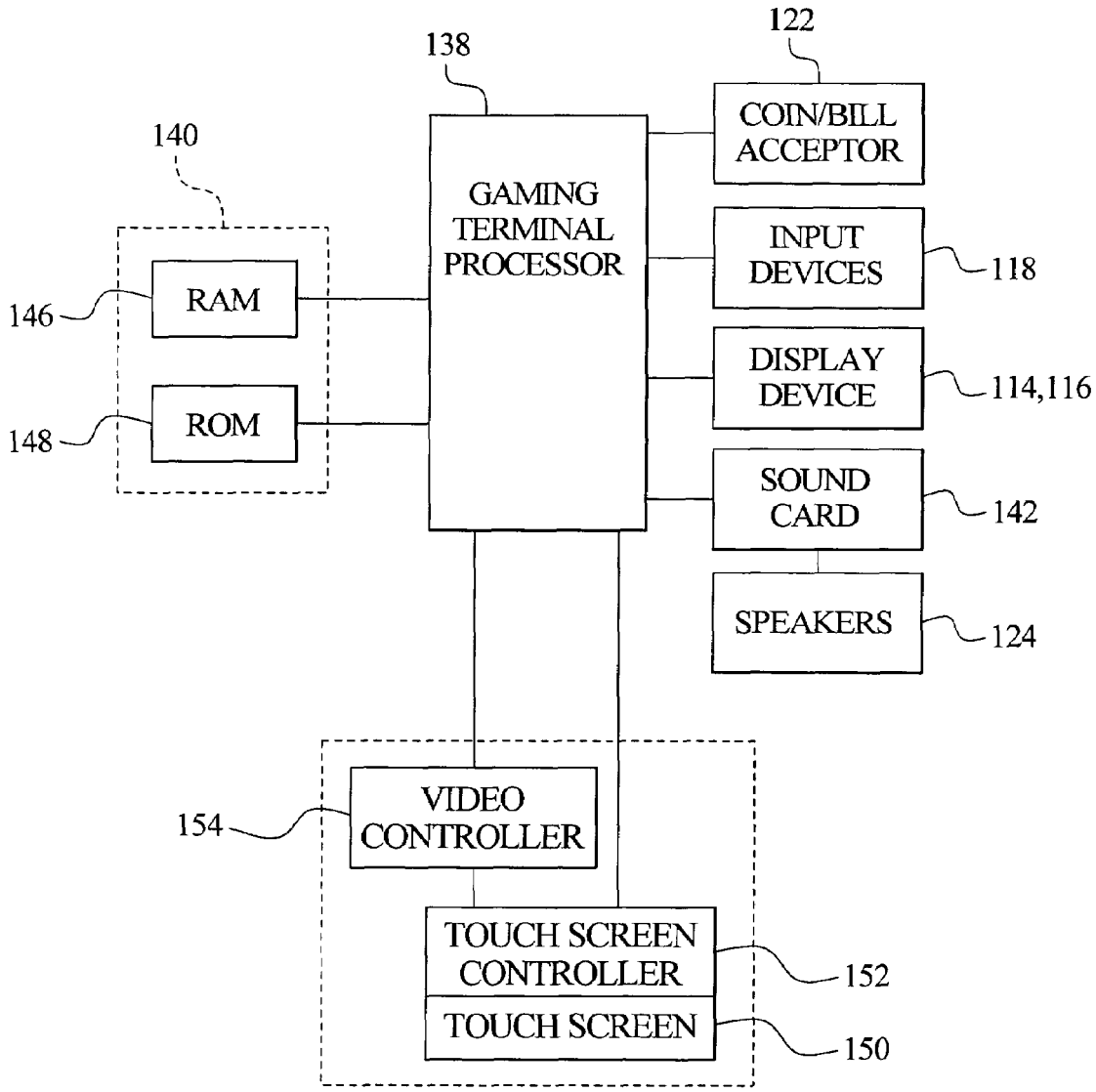
FIG. 3 is a schematic block diagram of an electronic configuration of one embodiment of the gaming terminal of the present invention.

Referring now to FIG. 3, gaming terminal 10 is run by a processor or central processing unit ("CPU") 138 and a memory device 140 that operates with one or more display devices 114 and 116 that display the generated Keno numbers. Processor 138 can be a microprocessor and have a microcontroller-based platform. The processor is operable with a communication device which is in communication with the central controller. The memory device 140 includes random access memory ("RAM") 146 and read only memory ("ROM") 148. The platform for the processor 38 and memory device 140 can be: (i) inside gaming terminal 10; or (ii) as stand alone components in the casino, part of a server/client system, data network, one or more application-specific integrated circuits (ASIC's) or one or more hard-wired devices. Furthermore, although the processor 138 and memory device 140 preferably reside on each gaming terminal 10 unit, it is possible to provide at least the function of selecting a game outcome seed (that is deterministic of a game outcome) from a pool or set of game outcome seeds, at a central location by a central controller such as a network server for communication to a playing station such as over a local area network (LAN), wide area network (WAN), Internet connection, microwave link, and the like.

Cabinet 112 of gaming terminal 10 also provides a number of speakers 124 that operate via a soundcard 142 with processor 138 to inform the player of any type of output, outcome or instruction of gaming terminal 10.

Gaming terminal 10 provides an electromechanical input device 18 or simulated input device provided by a touch screen 150 that operates via a touch screen controller 152 and a video controller 154 with the processor 138. The input devices enable the player to operate the Keno gaming terminal 10 of the present invention. One of the video monitors 114 and 116 and possibly, additionally the speakers 124 are used to explain: (i) when . . . ; (ii) how many . . . ; (iii) how much; and (iv) the type of award provided for obtaining the required number of matches.

The Keno game of the present invention can include any suitable variation of Keno. For purposes of the present invention, the game is illustrated in combination with the variation sometimes referred to as 'horse race' or Nevada Keno. In this Keno game, one or more players play against the house.

In addition to winning base game credits, the gaming terminal 10, including any of the base games disclosed above, also includes secondary or bonus games that give players the opportunity to win credits. The gaming terminal 10 preferably employs a video-based display device 130 or 132 for the secondary or bonus games. The secondary or bonus games include a program that automatically begins when the player achieves a qualifying condition or a secondary game triggering outcome in the base game, such as a certain number of matches, a specific number matched or a any other suitable triggering event.

Referring to FIG. 4, the game play of the keno game of the present invention is initiated by a player inserting the appropriate amount of money or tokens at one of the plurality of gaming terminals in communication with the central controller as indicated in block 202. The gaming terminal enables the player to push one of the electromechanical pushbuttons or touch the touch screen that operates with the display device to select one or more numbers or game choices to play from a plurality of different player selectable numbers or game choices as indicated in block 204. It should be appreciated that while numbers are used to describe the present invention, any other suitable game choice such as symbols, images or indicia may be implemented with the keno game of the present invention.

As illustrated in FIGS. 2B and 5, the player's selected numbers (bolded and bordered in FIG. 2B) 10, 25, 37, 53 and 74 designated by numeral 402 in FIG. 5. The available player selectable numbers from which the player may select from is preferably predetermined. The amount of player selectable numbers the player is enabled to select or play is either predetermined or from a predetermined range. For example, the player is enabled to pick either ten numbers or up to twenty numbers from the numbers one to eighty.

Referring to FIG. 4, after the player has selected one or more player selectable numbers, the gaming terminal accesses a standard set of predefined numbers for the specific game played as indicated in block 206. The gaming terminal accesses the standard set of predefined numbers based on the amount of player selectable numbers the player picked or elected to play. For example, as seen in FIG. 5, the player selected five numbers and the gaming terminal accessed the standard set of predefined numbers of 1, 2, 3, 4 and 5 designated by numeral 404 for the five-number keno game played.

The numbers included in the standard set of predefined numbers are from the same plurality of player selectable numbers the player is enabled to select one or more numbers from. The standard set of predefined numbers includes at least one number for each player selectable number the player picked or elected to play. That is, if the player selected five numbers, the standard set of predefined numbers would include at least five numbers from the plurality of player selectable numbers. If the player selected ten numbers, the standard set of predefined numbers would include at least ten numbers from the plurality of player selectable numbers. It should be appreciated that the standard set of predefined numbers for each of the plurality of gaming terminals in communication with the central controller are the same for each specific type of keno game played. That is, if two players at two independent gaming terminals each play the same type of keno game and select seven numbers, the standard set of predefined numbers accessed at each gaming terminal would includes at least the same seven numbers.

As illustrated in FIG. 4, the gaming terminal bidirectionally maps the player's selected numbers with the standard set of predefined numbers as indicated by block 208. That is, each one of the player's selected numbers is mapped onto a different one of the predefined numbers and the predefined number is reciprocally mapped onto the player's selected number. As described above, the standard set of predefined numbers includes at least the same amount of numbers as the amount of player selected numbers, therefore each player selected number will be bidirectionally mapped with a different predefined number. It should be appreciated that any one of the player's selected number can be bidirectionally mapped with any one of the predefined numbers as long as each player selected number is bidirectionally mapped with a different predefined number.

For example, as illustrated in FIGS. 5, if the player's selected numbers 10, 25, 37, 53 and 74 and the standard set of predefined numbers are 1, 2, 3, 4 and 5, the gaming terminal would map the player's selected numbers onto the predefined numbers and the predefined numbers onto the player's selected numbers 406. That is, predefined number 1 would be bidirectionally mapped with player selected number 10, predefined number 2 would be bidirectionally mapped with player selected number 25, predefined number 3 would be bidirectionally mapped with player selected number 37, predefined number 4 would be bidirectionally mapped with player selected number 53 and predefined number 5 would be bidirectionally mapped with player selected number 74. It should be appreciated that if the player selected number is the same as the predefined number, then the player selected number is preferably bidirectionally mapped with the same predefined number. That is, the number is mapped onto itself. It should be appreciated that in alternative embodiments, the gaming terminal could multidirectionally map the player's selected numbers with the standard set of predefined numbers.

After the gaming terminal bidirectionally maps each player selected number with a predefined number, the gaming terminal communicates a game outcome seed request to a central controller as indicated by block 210 of FIG. 4. The game play outcome request includes information regarding the type of keno game played, such as the amount of numbers the player selected.

Upon receiving the game outcome seed request, the central controller selects a game outcome seed from a set or pool of game outcome seeds as indicated by block 212. The central controller selects the game outcome seed from the set or pool that corresponds to the amount of numbers the player selected. That is, if the player selected four numbers, the central controller selects the game outcome seed from a different set or pool than had the player selected six numbers. In the example described above, since the player selected five numbers, the central controller selects a game outcome seed from a set or pool that corresponds to a keno game wherein the player selected five numbers.

The central controller marks or flags the selected game outcome seed in the pool as used or unavailable as indicated by block 214. Once a game outcome seed is marked or flagged it is prevented from a subsequent selection from the pool upon another game play. It should be appreciated that if the pool or set includes more than one of the same game outcome seed, then only the flagged game outcome seed cannot be selected upon a subsequent game outcome selection. For example, if a pool or set includes thirty win $5 game outcome seeds and one is selected and flagged, the flagged win $5 game outcome seed cannot be selected again but the other twenty-nine non-selected win $5 game outcome seeds remain available for subsequent game outcome selections.

The central controller communicates the selected game outcome seed to the requesting gaming terminal as indicated by block 216. It should be appreciated that other suitable methods of communicating a game outcome seed to a requesting gaming terminal may be employed in accordance with the present invention.

After acknowledging receipt of the selected game outcome seed, the gaming terminal utilizes the selected game outcome seed to generate one or more game numbers as indicated by block 218. In one embodiment, the gaming terminal utilizes the selected game outcome seed in a random number generating algorithm to generate at least one and preferably a plurality of random numbers. The gaming terminal then uses the generated random numbers to determine the game numbers.

For example, as illustrated in FIG. 5, based on the received game outcome seed, the gaming terminal generated the game numbers 2, 4, 7, 13, 15, 23, 29, 37, 41, 44, 48, 49, 62, 65 and 77 designated by numeral 408. If any of the gaming terminal generated numbers is not within the range of numbers offered to be selected by the player (i.e., if the player is allowed to select numbers from the range of numbers one to eighty and the gaming terminal generated number is greater than eighty), the gaming terminal will modulate the generated number in order to ensure that the generated game number falls within the range of player selectable numbers offered to the player.

It should be appreciated that if any one or more than one designated gaming terminals configured for playing a certain keno game receive the same specific game outcome seed, the resulting game numbers generated (and thus the resulting game outcomes) will preferably always be the same even though the different gaming terminals operate independently from one another. That is, if a plurality of the same gaming terminals each receive the same game outcome seed, then each of such same gaming terminals running the same random number generating algorithm will generate the same series of game numbers that correspond to the same game outcomes.

In one embodiment, the gaming terminal then determines if each of the generated game numbers needs to be modified prior to be being presented or illuminated to the player in order to ensure that the presented game outcome (based on the number of matches between the player's selected numbers and the gaming terminal presented generated numbers) is the same as the predetermined game outcome (based on the game outcome seed). That is, as the game outcome seed is deterministic of a game outcome and the game outcome of a keno game is based on the number of matches between the player's selected numbers and the gaming terminal presented generated numbers, the gaming terminal may need to modify (by using the created bidirectional map) at least one of the generated game numbers so that the number of matches the player obtains in the keno game corresponds to the number of matches of the predetermined game outcome. For example, if the game outcome seed for a ten number keno game is deterministic of a win $3 outcome which requires the player to match four of the ten selected numbers with the gaming terminal presented generated numbers and if the player's selected numbers and the unmodified gaming terminal generated game numbers results in five matches (which according to the appropriate paytable results in a win $6 outcome), the unmodified gaming terminal generated game numbers would need to be modified to ensure that the player obtains four matches.

In one embodiment, the gaming terminal accomplishes this modification, if needed, by determining if each of the unmodified generated game numbers is either a player selected number or a predefined number. That is, the gaming terminal determines if each of the generated numbers has previously been bidirectionally mapped onto another number.

As indicated by diamond 220 in FIG. 4, the gaming terminal determines if each of the unmodified generated game numbers (based on the game outcome seed) is the same number as a player selected number. For each unmodified generated number that is the same as a player selected number, the gaming terminal modifies the generated game number to the predefined number that is bidirectionally mapped with that player selected number as indicated by block 222. For example, as illustrated in FIG. 5, for the unmodified generated number 37, the gaming terminal would modify the unmodified generated number to modified game number/predefined number 3. That is, because the unmodified generated number 37 was also selected by the player, the gaming terminal would modify the gaming terminal generated/player selected number 37 to modified number/predefined number 3 which was bidirectionally mapped with number 37.

As indicated by diamond 224 in FIG. 4, the gaming terminal next determines if each of the generated game numbers (based on the game outcome seed) is the same number as a predefined numbers. For each generated game number that is the same number as a predefined number, the gaming terminal modifies the generated game number to the player selected number that is bidirectionally mapped with the predefined number as indicated by block 226. For example, as illustrated in FIG. 5, for the unmodified generated game numbers of 2 and 4, the gaming terminal would modify these generated game numbers to the modified game numbers/player selected numbers 25 and 53, respectively. That is, because the unmodified generated numbers 2 and 4 were also predefined numbers, the gaming terminal would modify the gaming terminal generated/predefined numbers 2 and 4 to modified numbers/ player selected numbers 25 and 53, respectively, which were bidirectionally mapped with numbers 2 and 4.

The gaming terminal then marks or illuminates (indicated by a slash-through in FIG. 2C) each modified game number as well as each remaining unmodified game number (i.e., game numbers that are not either also a player selected number or a predefined number) as indicated by block 228 in FIG. 4. In the example described above, as illustrated in FIGS. 2C and 5, the gaming terminal marks or illuminates numbers 3, 7, 13, 15, 23, 25, 29, 41, 45, 48, 49, 53, 62, 65 and 77 designated by numeral 410 in FIG. 5.

As illustrated in FIG. 4, after marking or illuminating a plurality of numbers, the gaming terminal compares the marked or illuminated numbers with the player's selected numbers. The gaming terminal provides the player a game outcome (a win outcome, a lose outcome or a bonus game triggering outcome) based on the amount of matches between the marked or illuminated numbers and the player's selected numbers as indicated by block 230. It should be appreciated that this game outcome is the same game outcome that the selected game outcome seed is deterministic of. That is, the present invention provides a keno game that enables a player to freely select a plurality of numbers and also enables the gaming terminal to randomly generate a plurality of game numbers based on the selected game outcome seed while still providing a predetermined game outcome. According to the applicable paytable for the player selecting five numbers and obtaining two matches, the gaming terminal provides the game outcome of $2. As illustrated in the display device 114 of FIG. 4C, appropriate messages such as "YOU MATCHED TWO NUMBERS" and "YOUR AWARD IS $2" are preferably provided to the game operator visually or through suitable audio or audiovisual displays.

If the provided game outcome is a bonus or secondary game triggering outcome, the game proceeds to enable the player to play at least one bonus or secondary game. A bonus or secondary game triggering outcome occurs when the player achieves a qualifying condition, such as a certain number of matches, a specific number match or a any other suitable triggering event. The bonus or secondary game proceeds as described above or in any other suitable method.

Regardless of how the game outcome is ultimately presented to the player, either as a value or payout from the primary or base game, as a value or payout from the secondary or bonus game, as a lose from the primary or base game or as a lose from the secondary or bonus game, the game outcome is predetermined. For example, if a particular game outcome in a $1 keno game of the present invention is a win outcome with an associated value or payout of $10, the outcome may be presented to the player as a $10 win outcome in the primary or base game, a $10 secondary or bonus game win outcome or any combination of payouts in the primary or base game and secondary or bonus game that result in a total payout of $10. Either way, the player is provided $10 and that particular game outcome seed is removed from the set of game outcome seeds.

It should be appreciated that any player selected number that randomly matches a gaming terminal generated game number would alter the predetermined game outcome. Therefore, by controlling or modifying (by bidirectionally mapping) which gaming terminal generated game numbers are marked or illuminated, the present invention ensures that the game outcome (which is indicated as the number of matches between the player's selected numbers and the gaming terminal generated game numbers) remains predetermined. In other words, the present invention is operable to modify (by bidirectionally mapping the predefined numbers with the player's selected numbers) the gaming terminal generated game numbers that are presented or illuminated to the player in order to provide that the player the predetermined game outcome which is based on the game outcome seed.

Figure 6:
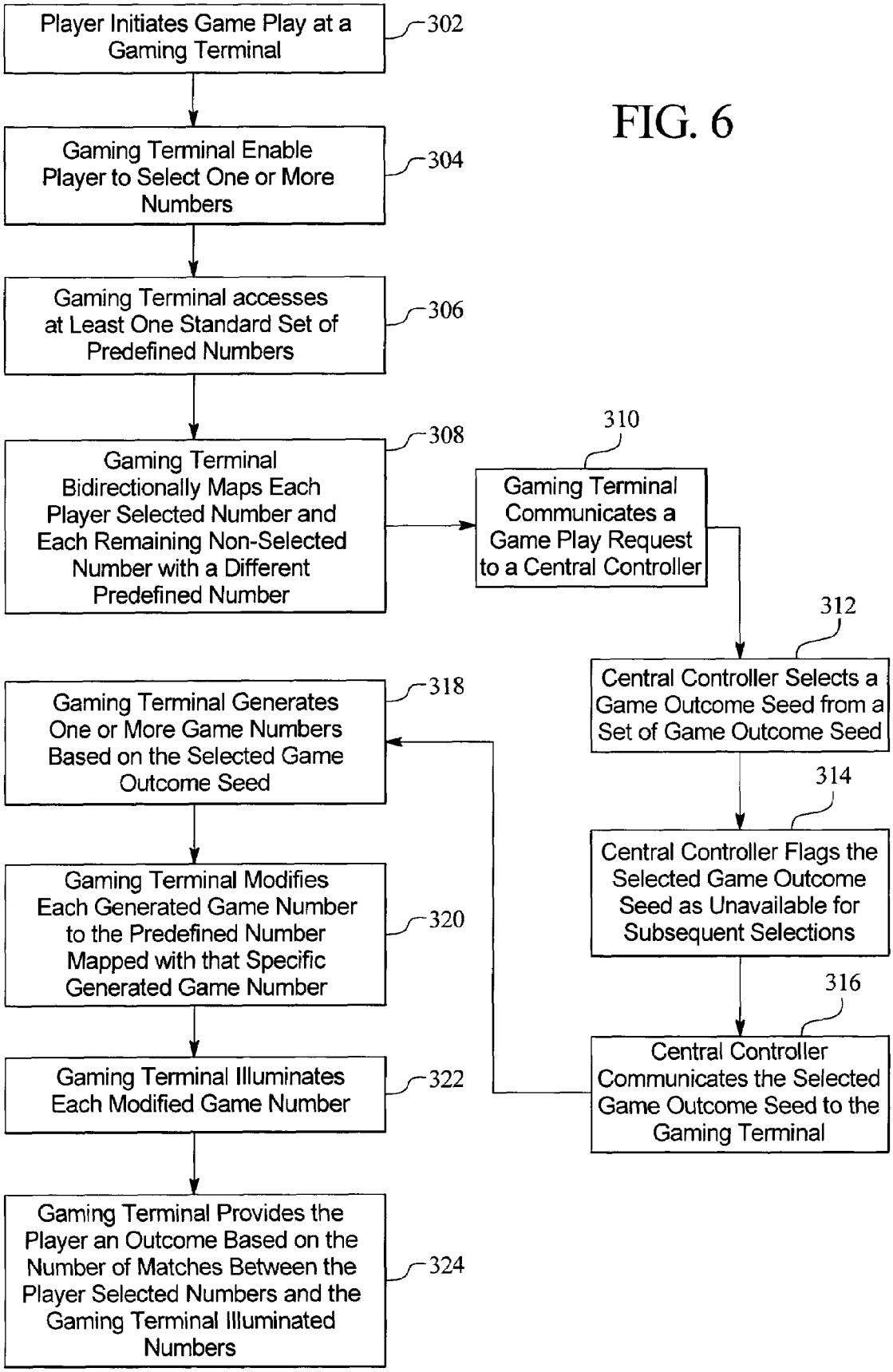
FIG. 6 is a schematic block diagram illustrating an alternative embodiment of the present invention wherein each of the gaming terminal generated game numbers are modified prior to being presented to the player in order to provide the player the predetermined game outcome that is based on the central controller selected game outcome seed.

Referring now to FIG. 6, in an alternative embodiment of the present invention, the gaming terminal randomly bidirectionally maps the player's selected numbers and the remaining non-selected numbers with different numbers from a standard set of predefined numbers. In this embodiment, upon a player initiating a game at one of the gaming terminals, the initiated gaming terminal enables the player to select one or more player selectable numbers as described above and as indicated by blocks 302 and 304.

As indicated by blocks 306 and 308, the gaming terminal accesses one standard set of predefined numbers and bidirectionally maps each of the player's selected numbers with a predefined number from this standard set of predefined numbers. The gaming terminal than accesses a second standard set of predefined numbers and bidirectionally maps each of the remaining non-selected numbers with a predefined number from this second standard set of predefined numbers. It should be appreciated that each predefined number in each set is a different one of the plurality of numbers selectable by the player.

This embodiment proceeds as described above, with the gaming terminal communicating a game outcome seed request to the central controller (wherein the request includes information or data regarding the number of numbers picked or selected by the player) as indicated by block 310. The central controller selects a game outcome seed from a set or pool of game outcome seeds for the specific keno game played (i.e., the number of numbers selected by the player), marks or flags the selected game outcome seed in the pool as used or unavailable and communicates the selected game outcome seed to the requesting gaming terminal as indicated by blocks 312, 314 and 316.

The gaming terminal utilizes the game outcome seed to generate one or more game numbers as indicated by block 318. The gaming terminal then modifies each generated game number to the corresponding predefined number that is bidirectionally mapped with each specific generated game number as indicated by block 320. It should be appreciated that in this embodiment, since each available number (both player selected and non-selected) is bidirectionally mapped with another number, the gaming terminal will determine the number that each generated number is bidirectionally mapped with and mark or illuminate these determined bidirectionally mapped numbers.

The gaming terminal marks or illuminates each modified game number as indicated by block 322. After marking or illuminating a plurality of modified numbers, the gaming terminal compares the marked or illuminated numbers with the player's selected numbers. The gaming terminal provides the player a game outcome based on the amount of matches between the marked or illuminated numbers and the player's selected numbers as indicated by block 324. As described above, this game outcome is the same game outcome that the selected game outcome seed is deterministic of.

For example, in a keno game of the present invention, the gaming terminal enables a player to select ten of thirty available numbers and the gaming terminal marks or illuminates twenty of the thirty numbers. In this example, the player's ten selected numbers would be bidirectionally mapped with the predefined numbers one through ten (the first standard set of predefined numbers) and the twenty remaining non-selected numbers would be bidirectionally mapped with the predefined numbers eleven through thirty (the second standard set of predefined numbers). It should be appreciated that the gaming terminal may randomly bidirectionally map the player's selected numbers and the remaining non-selected numbers with the same standard set of predefined numbers, but for illustration purposes, this embodiment is described using two standard sets of predefined numbers. For instance, if the standard set of predefined numbers includes the numbers one to thirty, the gaming terminal may designate the range of numbers one to ten as being mapped with player selected numbers and the remaining twenty numbers are designated to be mapped with the non-selected numbers.

In this example, if the selected game outcome seed is deterministic of a win $3 outcome and with reference to an appropriate paytable, a win $3 outcome corresponds to the player obtaining four matches between the player's selected numbers and the gaming terminal marked or illuminated numbers, then using the selected game outcome seed, the gaming terminal would generate the numbers one to four and eleven through twenty-six. As the numbers one through four are each bidirectionally mapped with a player selected number, the gaming terminal would mark or illuminate the corresponding player selected number that each of the generated numbers one through four are mapped to. Moreover, as the numbers eleven through twenty-six are each bidirectionally mapped with a non-selected number, the gaming terminal would mark or illuminate the corresponding non-selected number that each of the generated numbers eleven through twenty-six are mapped to. By marking or illuminating each generated numbers bidirectionally mapped number results in four matches between the player's selected numbers and the gaming terminal marked or illuminated numbers. With reference to the appropriate paytable, the four matches corresponds to a win $3 outcome which is the same outcome that the selected game outcome seed is deterministic of.

In this example, if the selected game outcome is deterministic of a win $10 outcome and with reference to an appropriate paytable, a win $10 outcome corresponds to the player obtaining seven matches between the player's selected numbers and the gaming terminal marked or illuminated numbers, then using the selected game outcome seed, the gaming terminal would generate the numbers one to seven and eleven through twenty-three. In this case, the numbers one through seven are each bidirectionally mapped with a player selected number and the gaming terminal would mark or illuminate the corresponding player selected number that each of the generated numbers one through seven are mapped to. This would result in seven matches between the player's selected numbers and the gaming terminal marked or illuminated numbers which, with reference to the appropriate paytable, corresponds to a win $10 outcome which is the same outcome that the selected game outcome seed is deterministic of. For this example, the central controller only needs to store eleven different types of game outcome seeds. That is, since the player is selecting ten numbers and the player can obtain between zero and ten matches between the player's selected numbers and the gaming terminal marked or illuminated numbers, the set or pool of game outcomes need only to contain eleven different types of game outcome seeds (i.e., one for each different number of matches the player can obtain).

This embodiment provides the advantage of reducing the amount of different game outcome seeds the central controller must maintain in each set or pool of game outcome seeds. That is, since each game outcome seed does not need to be deterministic of different lose numbers (numbers marked by the gaming terminal but not selected by the player), the pool or set of game outcome seeds need only contain one game outcome seed that is deterministic of each available game outcome (i.e., the number of matches obtained). In this embodiment, since the non-selected numbers are randomly bidirectionally mapped with numbers from a second standard set of predefined numbers, a plurality of game outcome seeds can each be deterministic of the same lose numbers because the actual lose number marked or illuminated by the gaming terminal will not be the generated lose number, but each of the lose numbers respective corresponding bidirectionally mapped number. Moreover, as the non-selected numbers are bidirectionally mapped with numbers from the second standard set of predefined numbers each time a player initiates the gaming terminal, a plurality of the same game outcomes, such as the player obtaining five matches, will be displayed differently to the player even though the same game outcome seed is used to determine the same game outcome.

In another embodiment (not shown), upon a player initiating a game play at one of the gaming terminals in communication with the central controller, the gaming terminal enables the player to select one or more numbers to play from a plurality of different player selectable numbers as described above. In this embodiment, after the player selects one or more player selectable numbers, the gaming terminal communicates a game outcome seed request (which includes information or data regarding the number of player selectable numbers the player picked) to the central controller. It should be appreciated that in this embodiment, the gaming terminal does not bidirectionally map the player's selected numbers with any predefined numbers. The central controller then selects a game outcome seed from a set of game outcome seeds for the specific keno game played, flags the selected game outcome seed and communicates the selected game outcome seed to the requesting gaming terminal.

In this embodiment, the gaming terminal determines the game outcome that the received game outcome seed is deterministic of and provides the player the determined game outcome. The gaming terminal presents the determined game outcome to the player by determining the number of matches between the player's selected numbers and the gaming terminal marked or illuminated numbers for the determined game outcome and then marking or illuminating the appropriate number of player selected numbers to correspond to the determined number matches. For example, if the game outcome seed is deterministic of a win $3 game outcome and according to an appropriate paytable for the specific game played, a win $3 game outcome corresponds to two of the player's ten selected numbers matching the twenty gaming terminal marked numbers, the gaming terminal will mark or illuminate two of the player's selected numbers and mark or illuminate eighteen non-selected numbers. In this embodiment, the gaming terminal will randomly mark two of the player's ten selected numbers and randomly mark eighteen of the remaining non-selected numbers.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A gaming terminal comprising:

a primary wagering keno game operable upon a wager by a player;

a plurality of predefined symbols associated with said primary wagering keno game;

a plurality of player selectable symbols;

a display device; and a processor in communication with said display device and operable to enable the player to initiate a play of the primary wagering keno game and for said play of the primary wagering keno game to:

(a) receive a game outcome seed from a central controller, (b) determine a game outcome in said primary wagering keno game based on said game outcome seed, (c) enable the player to select a set of symbols in said primary wagering keno game, (d) generate a set of symbols based on said received game outcome seed, (e) associate each of the player selected symbols with a different one of said predefined symbols, (f) associate each of the predefined symbols with a different one of said player selected symbols, (g) modify said generated set of symbols by:

(i) replacing each of said generated symbols which corresponds to one of the player selected symbols with its respective associated predefined symbol, and (ii) replacing each of said generated symbols which corresponds to one of the predefined symbols with its respective associated player selected symbol, (h) indicate said set of modified symbols to the player, and (i) provide the player the determined game outcome in said primary wagering keno game.

2. The gaming terminal of claim 1, wherein said processor is operable to receive a plurality of game outcome seeds from said central controller.

3. A central determination gaming system comprising:

a game outcome seed set, wherein said game outcome seed set includes a plurality of predetermined game outcome seeds and at least two of said game outcome seeds are deterministic of different game outcomes;

a central controller operable to select one of said game outcome seeds from said game outcome seed set, to prevent said selected game outcome seed from further selection from said game outcome seed set and to output said selected game outcome seed; and at least one gaming terminal including a display device and a processor in communication with said display device operable to enable a player to initiate a play of a keno game and for said play of the keno game to:

(a) receive said selected game outcome seed from said central controller, (b) determine a game outcome in said keno game based on said game outcome seed, (c) enable the player to select a set of selections in said keno game, (d) generate a set of selections based on said received game outcome seed, (e) associate each of the player selections with a different one of a plurality of predefined selections;

(f) associate each of the predefined selections with a different one of said player selections;

(g) modify said generated set of selections by:

(i) replacing each of said generated selections which corresponds to one of the player selections with its respective associated predefined selection, and (ii) replacing each of said generated selections which corresponds to one of the predefined selections with its respective associated player selection, (h) indicate said set of modified selections to the player, and (i) provide the player the determined game outcome in the keno game.

4. The central determination gaming system of claim 3, wherein said game outcome seed set includes a plurality of each game outcome seed.

5. The central determination gaming system of claim 3, which includes a plurality of game outcome seed sets.

6. A gaming terminal comprising:

a primary wagering keno game operable upon a wager by a player;

a plurality of symbols;

a display device; and a processor in communication with said display device and operable to enable the player to initiate a play of the primary wagering game and for said play of the primary wagering game to:

(a) enable the player to select one or more of said symbols, (b) receive a game outcome seed from a central controller, (c) determine a game outcome based on said received game outcome seed, (d) randomly generate a set of symbols based on said received game outcome seed, (e) associate each of the player selected symbols with a different one of a plurality of predefined symbols;

(f) associate each of the predefined symbols each a different one of the player selected symbols;

(g) modify said generated set of symbols by:

(i) replacing each of said generated symbols which corresponds to one of said player selected symbols with its respective associated predefined symbol, and (ii) replacing each of said generated symbols which corresponds to one of said predefined symbols with its respective associated player selected symbol, (h) mark one or more symbols of said modified set of symbols, (i) mark one or more of said remaining non-modified and non-player selected symbols, (j) present said marked symbols to the player, and (k) provide the player the determined game outcome in the primary wagering game.

7. The gaming terminal of claim 6, wherein said processor is operable to receive a plurality of game outcome seeds from said central controller.

8. A central determination gaming system comprising:

a game outcome seed set, wherein said game outcome seed set includes a plurality of predetermined game outcome seeds and at least two of said game outcome seeds are deterministic of different game outcomes;

a central controller operable to select one of said game outcome seeds from said game outcome seed set, to prevent said selected game outcome seed from further selection from said game outcome seed set and to output said selected game outcome seed; and at least one gaming terminal including a display device and a processor in communication with said display device operable to enable a player to initiate a play of a primary wagering game and for said play of the primary wagering game to:

(a) receive said selected game outcome from said central controller, (b) determine a game outcome based on said selected game outcome seed, (c) enable the player to pick one or more symbols from a plurality of symbols in said primary wagering game, (d) randomly generate a set of symbols based on said received game outcome seed, (e) associate each of the player selected symbols with a different one of a plurality of predefined symbols, (f) associate each of the predefined symbols with a different one of said player selected symbols, (g) modify said generated set of symbols by:

(i) replacing each of said generated symbols which corresponds to one of the player selected symbols with its respective associated predefined symbol, and (ii) replacing each of said generated symbols which corresponds to one of the predefined symbols with its respective associated player selected symbol, (h) mark one or more symbols of said modified set of symbols, (i) mark one or more of said remaining non-modified and non-player selected symbols, (j) present to the player each marked symbol, and (k) provide the determined game outcome to the player in the primary wagering game.

9. The central determination gaming system of claim 8, wherein said game outcome seed set includes a plurality of each game outcome seed.

10. The central determination gaming system of claim 8, which includes a plurality of game outcome seed sets.

11. The central determination gaming system of claim 8, wherein said symbols are numbers in a keno game.

12. A method of operating a gaming terminal comprising the steps of:

(a) enabling a player to initiate a primary wagering game, wherein said primary wagering game includes a plurality of symbols;

(b) enabling the player to select one or more of said symbols in said primary wagering game;

(c) receiving a game outcome seed from a central controller;

(d) determining a game outcome based on said received game outcome seed;

(e) randomly generating a set of symbols based on said received game outcome seed;

(f) associating each of the player selected symbols with a different one of a plurality of predefined symbols;

(g) associating each of the predefined symbols with a different one of said player selected symbols;

(f) modifying said generated set of symbols by:

(i) replacing each of said generated symbols which corresponds to one of the player selected symbols with its respective associated predefined symbol, and (ii) replacing each of said generated symbols which corresponds to one of the predefined symbols with its respective associated player selected symbol;

(g) marking one or more symbols of said modified set of symbols;

(h) marking one or more of said remaining non-modified and non-player selected symbols;

(i) presenting said marked symbols to the player; and (j) providing the determined game outcome to the player.

13. The method of claim 12, which is provided via a data network.

14. The method of claim 13, wherein the data network includes an internet.

15. A method of operating a gaming terminal, said method comprising:

(a) determining a game outcome in a primary wagering keno game based on a received game outcome seed, wherein a plurality of predefined symbols are associated with said primary wagering keno game;

(b) enabling a player to select a set of symbols in said primary wagering keno game;

(c) generating a set of symbols based on said received game outcome seed;

(d) associating each of the player selected symbols with a different one of said predefined symbols;

(e) associating each of the predefined symbols with a different one of said player selected symbols;

(f) modifying said generated set of symbols by:

(i) replacing each of said generated symbols which corresponds to one of the player selected symbols with its respective associated predefined symbol, and (ii) replacing each of said generated symbols which corresponds to one of the predefined symbols with its respective associated player selected symbol;

(g) indicating said set of modified symbols to the player; and (h) providing the player the determined game outcome in said primary wagering keno game.

16. The method of claim 15, which is provided via a data network.

17. The method of claim 16, wherein the data network includes an internet.

18. A method of operating a central determination gaming system, said method comprising:

(a) selecting one of a plurality of game outcome seeds from a game outcome seed set, wherein at least two of said game outcome seeds from said game outcome seed set are deterministic of different game outcomes;

(b) preventing said selected game outcome seed from further selection from said game outcome seed set;

(c) determining a game outcome in a keno game based on said selected game outcome seed;

(d) enabling a player to select a set of selections in said keno game;

(e) generating a set of selections based on said received game outcome seed;

(f) associating each of the player selections with a different one of a plurality of predefined selections;

(g) associating each of the predefined selections with a different one of said player selections;

(h) modifying said generated set of selections by:

(i) replacing each of said generated selections which corresponds to one of the player selections with its respective associated predefined selection, and (ii) replacing each of said generated selections which corresponds to one of the predefined selections with its respective associated player selection;

(i) indicating said set of modified selections to the player; and (j) providing the player the determined game outcome in the keno game.

19. The method of claim 18, which is provided via a data network.

20. The method of claim 19, wherein the data network includes an internet.

21. A method of operating a central determination gaming system, said method comprising:

(a) selecting one of a plurality of game outcome seeds from a game outcome seed set, wherein at least two of said game outcome seeds from said game outcome seed set are deterministic of different game outcomes;

(b) preventing said selected game outcome seed from further selection from said game outcome seed set;

(c) determining a game outcome based on said selected game outcome seed;

(d) enabling a player to pick one or more symbols from a plurality of symbols in a primary wagering game;

(e) randomly generating a set of symbols based on said received game outcome seed;

(f) associating each of the player selected symbols with a different one of a plurality of predefined symbols;

(g) associating each of the predefined symbols with a different one of said player selected symbols;

(h) modifying said generated set of symbols by:

(i) replacing each of said generated symbols which corresponds to one of the player selected symbols with its respective associated predefined symbol, and (ii) replacing each of said generated symbols which corresponds to one of the predefined symbols with its respective associated player selected symbol;

(i) marking one or more symbols of said modified set of symbols;

(j) marking one or more of said remaining non-modified and non-player selected symbols;

(k) presenting to the player each marked symbol; and (l) providing the determined game outcome to the player in the primary wagering game.

22. The method of claim 21, wherein said symbols are numbers in a keno game.

23. The method of claim 21, which is provided via a data network.

24. The method of claim 23, wherein the data network includes an internet.

* * * * *